US008721120B2

(12) United States Patent
Christ et al.

(10) Patent No.: US 8,721,120 B2
(45) Date of Patent: May 13, 2014

(54) FOLDING WORKLIGHT WITH ATTACHMENT MECHANISM

(71) Applicants: James Richard Christ, Peachtree City, GA (US); Chris Bryant, Social Circle, GA (US)

(72) Inventors: James Richard Christ, Peachtree City, GA (US); Chris Bryant, Social Circle, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/868,825

(22) Filed: Apr. 23, 2013

(65) Prior Publication Data

US 2013/0329430 A1 Dec. 12, 2013

Related U.S. Application Data

(63) Continuation of application No. 12/832,523, filed on Jul. 8, 2010, now Pat. No. 8,430,529, which is a continuation-in-part of application No. 12/403,575, filed on Mar. 13, 2009, now Pat. No. 7,954,980.

(51) Int. Cl.
*F21S 4/00* (2006.01)
*F21V 21/00* (2006.01)

(52) U.S. Cl.
USPC ..... 362/249.03; 362/183; 362/249.1; 362/287; 362/427

(58) Field of Classification Search
USPC ..... 362/183, 184, 249.03, 249.05, 249.09, 362/249.1, 287, 397, 398, 427; D26/37, 42
See application file for complete search history.

(56) References Cited

U.S. PATENT DOCUMENTS

| | | | | |
|---|---|---|---|---|
| 4,528,618 | A | 7/1985 | Bitsch | |
| 5,424,931 | A | 6/1995 | Wheeler | |
| 5,515,247 | A | 5/1996 | Cheung et al. | |
| D372,997 | S | 8/1996 | Meoli | |
| 5,595,441 | A | 1/1997 | McGee | |
| D382,359 | S | 8/1997 | Rorke et al. | |
| D391,656 | S | 3/1998 | Wan | |
| D392,062 | S | 3/1998 | Wan | |
| D396,891 | S | 8/1998 | Lam | |
| 5,890,793 | A | 4/1999 | Stephens | |
| 6,164,801 | A | 12/2000 | Alexander-Katz | |
| 6,808,208 | B2 | 10/2004 | Ward | |
| 6,857,756 | B2 | 2/2005 | Reiff et al. | |
| D505,217 | S | 5/2005 | Bayat et al. | |
| 6,979,100 | B2 | 12/2005 | Reiff et al. | |
| 7,121,688 | B2 | 10/2006 | Rempel | |
| D540,484 | S | 4/2007 | Bayat et al. | |
| 7,234,833 | B2 * | 6/2007 | Hatherill et al. | 362/198 |
| D546,490 | S | 7/2007 | Brown et al. | |

(Continued)

*Primary Examiner* — Nimeshkumar Patel
*Assistant Examiner* — Jose M Diaz
(74) *Attorney, Agent, or Firm* — King & Spalding LLP

(57) ABSTRACT

An LED worklight includes a center core and a first panel and a second panel coupled to the center core. The first panel includes a first LED die package disposed within a first opening formed within the first panel and a first lens disposed over the first LED die package. The second panel includes features similar to the first panel. The second panel is rotatable around the center core from a zero degree closed orientation to about a 359 degree orientation, and is positionable at any intermediate angle therebetween. The first and second panels each include an attachment mechanism having an elastic band with a hook attached thereto. The attachment mechanisms are used to attach or hang the worklight to or around one or more objects. The attachment mechanisms are stored in the worklight such that the attachment mechanisms do not interfere with its operation when not in use.

20 Claims, 14 Drawing Sheets

(56) References Cited

U.S. PATENT DOCUMENTS

| | | | | |
|---|---|---|---|---|
| D550,385 | S | 9/2007 | Hamilton et al. | |
| D556,926 | S | 12/2007 | Thirouin | |
| D558,369 | S | 12/2007 | O'Hern | |
| D567,977 | S | 4/2008 | Jianwei | |
| D567,978 | S | 4/2008 | Jianwei | |
| D581,569 | S | 11/2008 | Levine | |
| D588,733 | S | 3/2009 | O'Hern | |
| D593,695 | S | 6/2009 | Levine | |
| 7,556,398 | B2 | 7/2009 | Van Der Poel | |
| 7,559,665 | B1 | 7/2009 | Pfanstiehl | |
| 7,717,586 | B2 * | 5/2010 | Tucker | 362/249.05 |
| D620,627 | S | 7/2010 | Kovacik et al. | |
| 7,810,948 | B2 | 10/2010 | Ogashiwa | |
| D636,915 | S | 4/2011 | Bryant et al. | |
| D637,749 | S | 5/2011 | Bayat et al. | |
| D638,153 | S | 5/2011 | Christ et al. | |
| 7,954,980 | B2 | 6/2011 | Bryant et al. | |
| 8,002,438 | B2 | 8/2011 | Ko | |
| 2004/0004828 | A1 | 1/2004 | Chernick et al. | |
| 2004/0032732 | A1 | 2/2004 | Rubin | |
| 2004/0042199 | A1 | 3/2004 | Cok | |
| 2004/0246712 | A1 * | 12/2004 | Endo | 362/190 |
| 2006/0034091 | A1 | 2/2006 | Kovacik et al. | |
| 2006/0043085 | A1 | 3/2006 | Meyers | |
| 2006/0104069 | A1 | 5/2006 | Beveridge et al. | |
| 2008/0043457 | A1 | 2/2008 | Braxson | |
| 2010/0110700 | A1 | 5/2010 | Chien | |
| 2010/0232147 | A1 | 9/2010 | Bryant et al. | |
| 2011/0255286 | A1 | 10/2011 | Christ et al. | |

* cited by examiner

FOLDING WORKLIGHT WITH ATTACHMENT MECHANISM

CROSS REFERENCE TO RELATED APPLICATIONS

This non-provisional patent application is a continuation of and claims priority under 35 U.S.C. §120 to U.S. patent application Ser. No. 12/832,523, titled, "Folding Worklight With Attachment Mechanism," filed Jul. 8, 2010, which is a continuation-in-part of U.S. patent application Ser. No. 12/403,575, titled, "Folding Rechargeable Worklight," filed Mar. 13, 2009, the entire contents of each application are hereby fully incorporated herein by reference.

TECHNICAL FIELD

The present invention relates generally to electrical lighting devices, and more particularly, to a portable worklight having integral elastic bands with hooks for fastening the worklight to or around an object.

BACKGROUND

There is often a need to enhance area lumination by using portable lighting products. One such portable lighting product is a worklight, which may be used in various settings needing light in small spaces, including, but not limited to, repair settings such as an automotive repair shop, construction settings, and other areas where no electrical outlet exists. These conventional worklights are often in a form that may be handheld or hung from a suitable elevated object.

Conventional worklights that have been in use include incandescent worklights and fluorescent worklights. Incandescent worklights provide some concerns when used in particular circumstances. Since worklights are typically used in small areas or are hung from an elevated object, the worklights may be bumped and fall. When an incandescent worklight is bumped or falls, the bulb and/or the filament can easily break, thereby making the incandescent worklight inoperable. Additionally, if the bulb breaks when being used within a flammable area, the hot filament may cause nearby flammable material to ignite and cause a fire hazard.

Although fluorescent worklights have advantages over incandescent worklights, namely, greater energy efficiency and a reduced hazard of igniting flammable materials if they fall, these fluorescent worklights suffer a similar disadvantage as incandescent worklights, for example, potentially causing a fire hazard when broken. Although there is a reduced hazard of igniting flammable materials when the worklight falls or is dropped, there is a hazard nonetheless. Fluorescent bulbs are better protected from breaking, but can still break when impacted on a hard surface. The hot electrodes within an operating fluorescent bulb may ignite nearby flammable materials when exposed during a fall.

More recently, LED worklights have been used because of certain advantages over incandescent and fluorescent worklights. LED worklights are better suitable for remaining intact after a fall. Furthermore, light source of LED worklights operate at a much lower operating temperature than the light sources of incandescent and fluorescent worklights. Thus, these lower operating temperatures are less likely to cause fires in the event of an LED worklight falling and breaking. Moreover, LED worklights provide for increased power savings when compared to incandescent and fluorescent worklights having similar lamination wattages.

One form of the conventional LED worklight is a LED stick light, where an LED array is coupled to a circuit board and mounted within a narrow hollow tube, which is at least partially transparent. The LED stick light can include a hook at one end to hang the stick light from an elevated object. These LED stick lights, however, have certain drawbacks associated with them. One drawback is that the LED stick light has a small base and is unstable during use when placed on a flat surface. A further drawback is that the LED stick light can be mounted to only one surface when using a magnet. Yet, another drawback is that the lens/transparent cover is capable of being damaged during storage or use. An additional drawback to the LED stick light is that the light output is focused only in a single small area and may be varied only by turning the entire LED light stick.

Furthers drawbacks to the LED stick light are associated with the sticklight's hook. One drawback is that the hook is non-retractable. The non-retractable hook can interfere with nearby objects and potentially be damaged when using and/or storing the LED stick light. Another drawback is that the hook is rigid and therefore dependent on the physical size and shape of the hook and the objects upon which the hook can engage for support. In many applications, there are typically multiple objects available near the intended area of illumination that could potentially be used to support a worklight. However, the limitations of the rigid or semi-rigid hook designs preclude their use.

SUMMARY

The present invention provides a worklight capable of attaching to or hanging from one or more objects. According to one embodiment, a worklight can include a first panel and a second panel rotatably coupled to the first panel. A light source can be disposed on the first panel. An attachment mechanism can be coupled to the first panel. A light source can be disposed on the second panel.

According to another embodiment, a worklight can include a substantially cylindrical center core including an interior and an exterior. The interior of the center core can include a cavity for receiving a power source. The interior also can include a switch mechanism. The switch mechanism can include a manually adjustable portion disposed on the exterior of the center core. The worklight also can include a first panel coupled to the center core. A light source can be disposed along a surface of the first panel. An attachment mechanism can be coupled to the first panel. The worklight also can include a second panel rotatably coupled to the center core. A light source can be disposed along a surface of the second panel. An attachment mechanism can be coupled to the second panel.

According to yet another embodiment, a portable worklight can include a center core. The portable worklight can include a substantially C-shaped first panel coupled to the center core. A light emitting diode ("LED") package can be coupled to the first panel. The portable worklight also can include an attachment mechanism including an elastic band having a first end rotatably coupled to the first panel and a second end coupled to a hook. The portable worklight also can include a substantially C-shaped second panel coupled to the center core. An LED package can be coupled to the second panel. The portable worklight also can include an attachment mechanism including an elastic band having a first end rotatably coupled to the first panel and a second end coupled to a hook.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
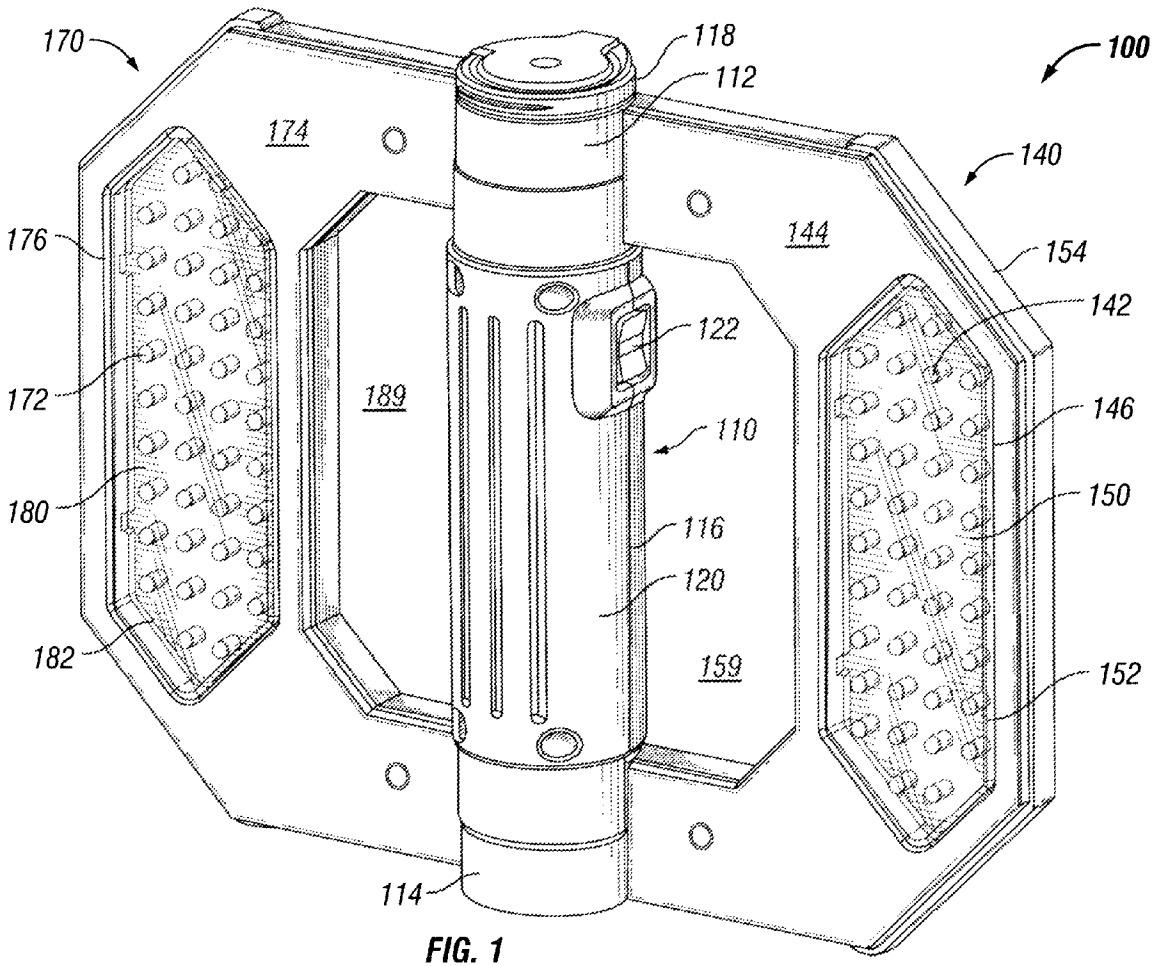
FIG. 1 shows a perspective view of an LED worklight in an open configuration in accordance with an exemplary embodiment.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements.

DETAILED DESCRIPTION OF EXEMPLARY EMBODIMENTS

The present invention is directed to electrical lighting devices. In particular, certain exemplary embodiments of the application are directed to a portable worklight which utilizes elongated members having an attachment mechanism, such as a hook, for attaching the worklight to nearby objects. The elongated members can include elastic or semi-elastic material that allows the members to wrap around objects and increases flexibility of mounting or positioning the worklight. Although the description of exemplary embodiments of the invention is provided below in conjunction with light emitting diodes ("LEDs"), alternate embodiments of the invention may be applicable to other types of lamps including, but not limited to, incandescent lamps, fluorescent lamps, cold cathode fluorescent lamps, organic LEDs ("OLEDs"), xenon or halogen lamps, or a combination of lamp types known to persons of ordinary skill in the art.

Figure 2:
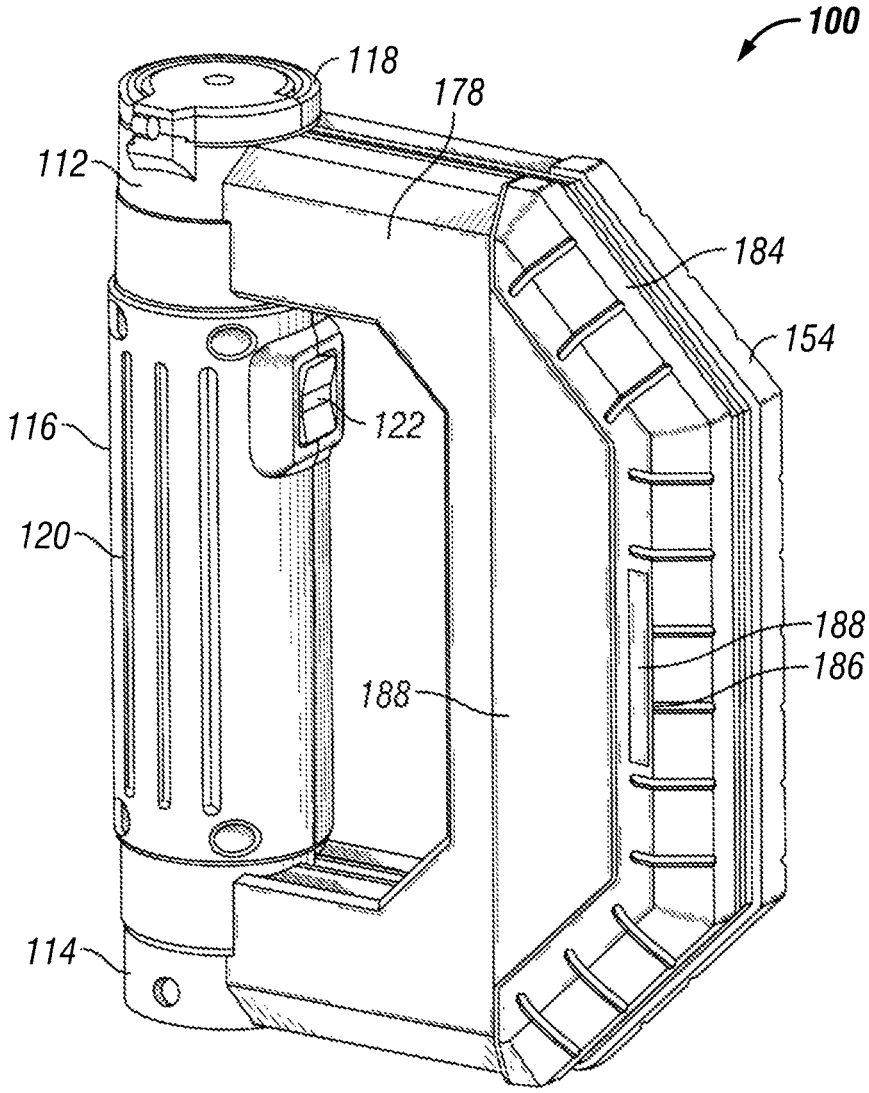
FIG. 2 shows a perspective view of the LED worklight of FIG. 1 in a closed configuration in accordance with an exemplary embodiment.

The invention may be better understood by reading the following description of non-limiting, exemplary embodiments with reference to the attached drawings, wherein like parts of each of the figures are identified by the same reference characters, and which are briefly described as follows. FIG. 1 shows a perspective view of an LED worklight 100 in an open configuration in accordance with an exemplary embodiment of the present invention. FIG. 2 shows a perspective view of the LED worklight 100 of FIG. 1 in a closed configuration in accordance with an exemplary embodiment of the present invention. Referring to FIGS. 1 and 2, the LED worklight 100 includes a center core 110, a first panel 140 rotatably coupled to the center core 110, and a second panel 170 rotatably coupled to the center core 110. The first panel 140 includes a first array of LEDs 142 and the second panel 170 includes a second array of LEDs 172. The LED worklight 100 may be portable.

The center core 110 includes a first section 112, a second section 114, and a middle section 116 located between the first section 112 and the second section 114. In one exemplary embodiment, the center core 110 is fabricated at least partially by portions of the first panel 140 and the second panel 170, which will be further described in conjunction with FIG. 3. Additionally, the center core 110 houses several components, which also will be further discussed below in conjunction with FIG. 3. According to one exemplary embodiment, the first section 112, the second section 114, and the middle section 116 have a substantially cylindrical shape. Although the middle section 116 has been illustrated with a substantially cylindrical shape, the middle section 116 may be any geometrical shape, including triangular, rectangular, or hexagonal, without departing from the scope and spirit of the present invention. In one exemplary embodiment, the center core 110 is fabricated from any suitable material including, but not limited to, plastics, rubber, polymers, metals, and metal alloys.

The center core 110 further includes a switch 122 for controlling the first array of LEDs 142 and the second array of LEDs 172. In one exemplary embodiment, the switch 122 is positioned on the exterior of the center core 110 and along the middle section 116. The exemplary switch 122 is of any type of switch known to persons of ordinary skill in the art, including, but not limited to, sliding switches, rocking switches, and push button switches, without departing from the scope and spirit of the present invention. Although one switch has been illustrated, the alternative exemplary embodiments may include multiple switches, with each switch controlling one array of LEDs. Additionally, although the switch 122 has been positioned along the middle section 116 of the center core 110, the switch may be positioned anywhere on the LED worklight's 100 surface.

The center core 110 also includes a hook 118 coupled to the first section 112 or the second section 114 (not shown) for hanging the LED worklight 100 in a vertical orientation to a suitable elevated object. According to one exemplary embodiment, the hook 118 is retractable into the first section 112 to reduce potential damage and interference when not in use. According to one embodiment of the present invention, the hook 118 rotates downwardly to the first section 112 and is sized to have an outer circumference substantially equal to or less than the outer circumference of the first section 112. According to some embodiments, the hook 118 is shaped to substantially match the shape of the first section's 112 outer circumference. The hook 118 may employ alternative retracting methods including, but not limited to, a spring retraction and extraction method, which minimizes the hook 118 from extending substantially beyond the LED worklight's 100 profile. The hook 118 is fabricated from any suitable material including, but not limited to, plastics, rubbers, polymers, metals, and metal alloys. Although the hook 118 is retractable in this embodiment, alternate exemplary embodiments utilize a non-retractable hook without departing from the scope and spirit of the present invention.

Additionally, the center core 110 further includes a grip 120 coupled circumferentially around at least a portion of the middle section 116 so that an operator may easily grip the LED worklight 100. The grip 120 may have any surface including, but not limited to, smooth, ribbed, and dimpled. The grip 120 is fabricated from any suitable material including, but not limited to, plastics, rubbers, polymers, metals, and metal alloys. In one exemplary embodiment, the grip 120 is fabricated from a friction increasing rubber material.

The first panel 140 includes a first panel front side 144 having a first panel opening 146 formed therein, a first panel rear side (not shown), a first panel circuit board 150, and the first array of LEDs 142. The first array of LEDs 142 is mounted onto the first panel circuit board 150. According to one exemplary embodiment, the first array of LEDs 142 includes one or more white LEDs having a 5 millimeter ("mm") dome top and operating at about 20 milliamps. Alternate embodiments of the present invention may use different types of LEDs or different sizes of LEDs including, but not limited to, colored LEDs or a mixture of colored and white LEDs. Exemplary colors for the colored LEDs include all non-white colors including, but not limited to, red, green, and amber. Although this embodiment depicts forty LEDs in the first array of LEDs 142, the number of LEDs may be greater or fewer than forty without departing from the scope and spirit of the exemplary embodiment. Furthermore, while the first array of LEDs 142 has a substantially diamond-shaped appearance, other shapes and sizes of array are within the scope of the present invention including, but not limited to, rectangular, square, and oval. As the number of LEDs increases, the battery life decreases. Additionally, in one exemplary embodiment, the LEDs are dimmable and capable of having light output at various intensities. Moreover, each of the LEDs is typically mounted perpendicular to the first panel circuit board 150. In alternate embodiments, each of the LEDs is mounted at an angle with respect to the first panel circuit board 150 or in a combination of perpendicular and angular arrangements on the first panel circuit board 150. In one example, the angle at which the LED is mounted ranges from about 0 degrees from perpendicular to about 45 degrees on either side of perpendicular. In yet another example, the angle at which the LED is mounted ranges from about 0 degrees from perpendicular to about 90 degrees on either side of perpendicular.

The first panel circuit board 150 and the first array of LEDs 142 are releasably coupled to the first panel opening 146. According to this embodiment, the first panel circuit board 150 and the first array of LEDs 142 are disposed within the first panel opening 146. Some alternative embodiments, however, have the first panel circuit board 150 and the first array of LEDs 142 coupled to the surface of the first panel 140. Although the first panel opening 146 has been illustrated having a hexagonal-shaped appearance, other shapes and sizes of the first panel opening 146 are within the scope of the present invention including, but not limited to, rectangular, square, and oval.

The first panel 140 further includes a first panel lens 152 coupled to the first panel 140 along the edge of the first panel opening 146 and disposed over the first array of LEDs 142. In one exemplary embodiment, the first panel lens 152 has the same geometric shape as the first panel opening 146; however, this is not necessary. In one exemplary embodiment, the first panel lens 152 is transparent. In alternate exemplary embodiments, the first panel lens 152 is tinted any color including, but not limited to, grey, red, and amber. The first panel lens 152 is fabricated from a plastic material, a glass material, or any other translucent material. The first panel lens 152 acts as a protective cover for the first array of LEDs 142. Additionally, some embodiments utilize the first panel lens 152 to direct or diffuse the light output from the first array of LEDs 142 according to a desired pattern. In one exemplary embodiment, the first panel lens 152 is about 2 mm thick. However, the thickness of the first panel lens 152 can be more or less without departing from the scope and spirit of the present invention.

The first panel 140 also includes a first molding 154 extending around at least a portion of the outer perimeter of the first panel rear side (not shown) and over the side edge of the first panel 140. Additionally, the first panel 140 further includes at least one first panel magnet 398 (FIG. 3) coupled to the first panel rear side (not shown). Since the first panel rear side (not shown) is similar to a second panel rear side 178, the first molding 154 and the at least one first panel magnet 398 (FIG. 3) will be further described below when describing the second molding 184 and at least one second panel magnet 188.

Figure 5:
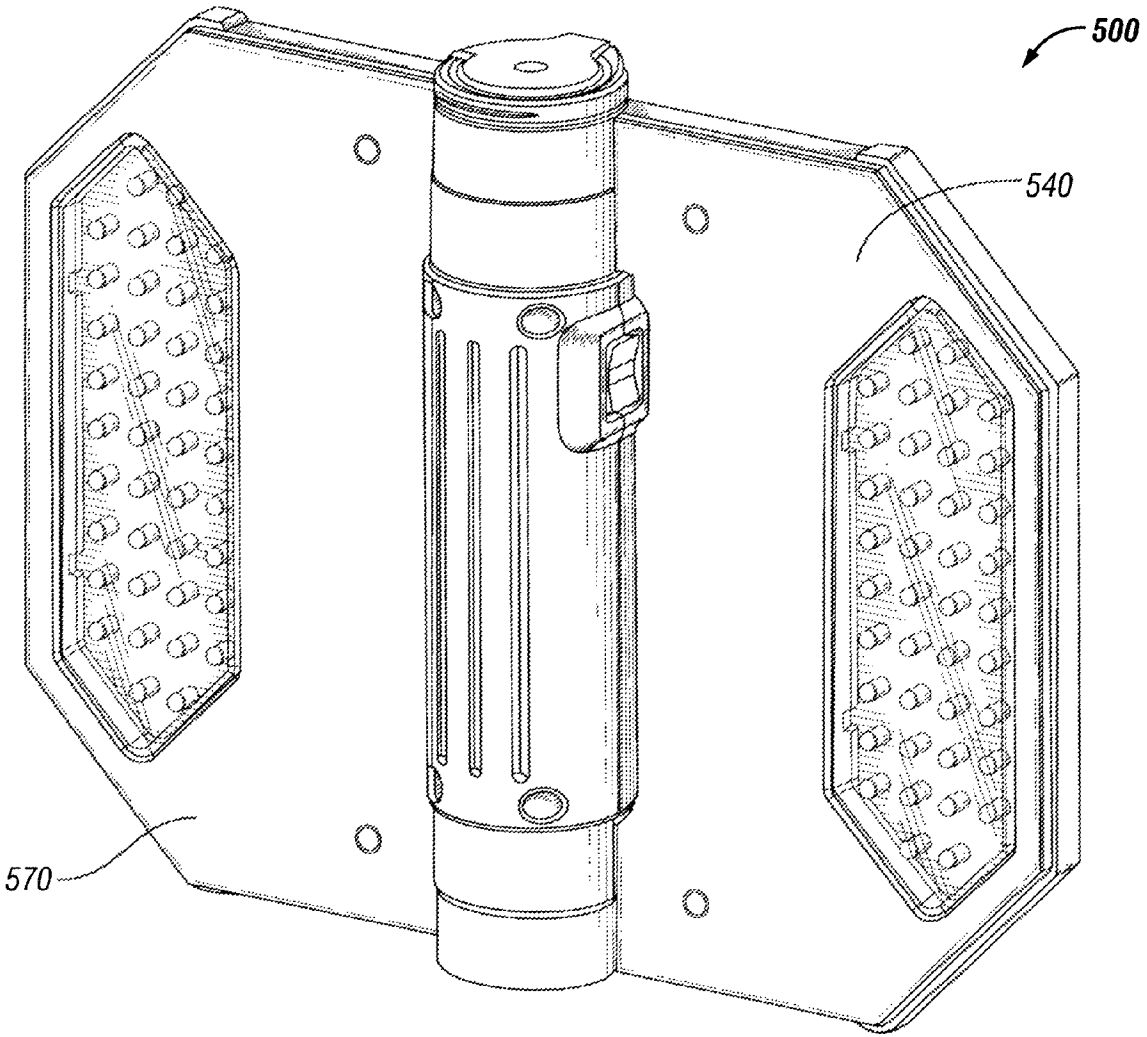
FIG. 5 shows a perspective view of an LED worklight in an open configuration in accordance with an alternative exemplary embodiment.

According to one exemplary embodiment, the first panel 140 is C-shaped, thereby forming a first air space 159 between a substantial portion of the first panel 140 and the center core 110. In this embodiment, the center core 110 functions as a handle. Although the first panel 140 has been illustrated as being C-shaped, the first panel 140 can be of any geometric shape without departing from the scope and spirit of the present invention. An example of one geometric shape that the first panel may have is illustrated in FIG. 5, which will be further described below.

Similarly, the second panel 170 includes a second panel front side 174 having a second panel opening 176 formed therein, the second panel rear side 178, a second panel circuit board 180, and the second array of LEDs 172. The second array of LEDs 172 is mounted onto the second panel circuit board 180. According to one exemplary embodiment, the second array of LEDs 172 includes one or more white LEDs having a 5 mm dome top and operating at about 20 milliamps. Alternate embodiments of the present invention may use different types of LEDs or different sizes of LEDs including, but not limited to, colored LEDs or a mixture of colored and white LEDs. Exemplary colors for the colored LEDs include all non-white colors including, but not limited to, red, green, and amber. Although this embodiment depicts forty LEDs in the second array of LEDs 172, the number of LEDs may be greater or fewer than forty without departing from the scope and spirit of the exemplary embodiment. Furthermore, while the second array of LEDs 172 has a substantially diamond-shaped appearance, other shapes and sizes of array are within the scope of the present invention including, but not limited to, rectangular, square, and oval. As the number of LEDs increases, the battery life decreases. Additionally, in one exemplary embodiment, the LEDs are dimmable and capable of having light output at various intensities. Moreover, each of the LEDs is typically mounted perpendicular to the second panel circuit board 180. In alternate embodiments, each of the LEDs is mounted at an angle with respect to the second panel circuit board 180 or in a combination of perpendicular and angular arrangements on the second panel circuit board 180. In one example, the angle at which the LED is mounted ranges from about 0 degrees from perpendicular to about 45 degrees on either side of perpendicular. In yet another example, the angle at which the LED is mounted ranges from about 0 degrees from perpendicular to about 90 degrees on either side of perpendicular.

The second panel circuit board 180 and the second array of LEDs 172 are releasably coupled to the second panel opening 176. According to this embodiment, the second panel circuit board 180 and the second array of LEDs 172 are disposed within the second panel opening 176. Some alternative embodiments, however, have the second panel circuit board 180 and the second array of LEDs 172 coupled to the surface of the second panel 170. Although the second panel opening 176 has been illustrated having a hexagonal-shaped appearance, other shapes and sizes of the second panel opening 176 are within the scope of the present invention including, but not limited to, rectangular, square, and oval.

The second panel 170 further includes a second panel lens 182 coupled to the second panel 170 along the edge of the second panel opening 176 and disposed over the second array of LEDs 172. In one exemplary embodiment, the second panel lens 182 has the same geometric shape as the second panel opening 176; however, this is not necessary. In one exemplary embodiment, the second panel lens 182 is transparent. In alternate exemplary embodiments, the second panel lens 182 is tinted any color including, but not limited to, grey, red, and amber. The second panel lens 182 is fabricated from a plastic material, a glass material, or any other translucent material. The second panel lens 182 acts as a protective cover for the second array of LEDs 172. Additionally, some embodiments utilize the second panel lens 182 to direct or diffuse the light output from the second array of LEDs 172 according to a desired pattern. In one exemplary embodiment, the second panel lens 182 is about 2 mm thick. However, the thickness of the second panel lens 182 can be more or less without departing from the scope and spirit of the present invention.

The second panel 170 also includes a second molding 184 extending around at least a portion of the outer perimeter of the second panel rear side 178 and over the side edge of the second panel 170. The second molding 184 is fabricated from a protective material known to persons of ordinary skill in the art including, but not limited to, rubbers, polymers, and plastics. According to some embodiments, the second molding 184 includes a second molding aperture 186. The second molding 184 and the first molding 154 provide protection to the LED worklight 100 from damage.

The second panel 170 also includes at least one second panel magnet 188 coupled to the second panel rear side 178. According to an exemplary embodiment, there are two second panel magnets 188 coupled to the second panel rear side 178, wherein one of the second panel magnets is recessedly coupled within the second molding aperture 186. This at least one second panel magnet 188 allows the second panel 170 of the LED worklight 100 to be coupled to a ferrous surface, which may be the same planar ferrous surface that the first panel 140 couples to or a ferrous surface that is adjacent to and angled with respect to the ferrous surface that the first panel 140 couples to. Although magnets have been illustrated in this embodiment, other devices may be used to couple the second panel 170 to ferrous and/or non-ferrous surfaces including, but not limited to, suction grips as shown and describe in conjunction with FIG. 6, without departing from the scope and spirit of the present invention.

According to one exemplary embodiment, the second panel 170 is C-shaped, thereby forming a second air space 189 between a substantial portion of the second panel 170 and the center core 110. In this embodiment, the center core 110 functions as a handle. Although the second panel 170 has been illustrated as being C-shaped, the second panel 170 can be of any geometric shape without departing from the scope and spirit of the present invention. An example of one geometric shape that the second panel may have is illustrated in FIG. 5, which will be further described below.

According to one exemplary embodiment, the LED worklight 100 is about 10" from the top of the first section 112 to the bottom of the second section 114 and about 12" wide when the first panel 140 and the second panel 170 are oriented 180 degrees apart in the open configuration. The first panel 140 and the second panel 170 are approximately ¾" thick. Additionally, the center core 110 has about a 2" diameter. Although exemplary dimensions have been provided for the LED worklight 100, the dimensions may vary without departing from the scope and spirit of the present invention.

Figure 3:
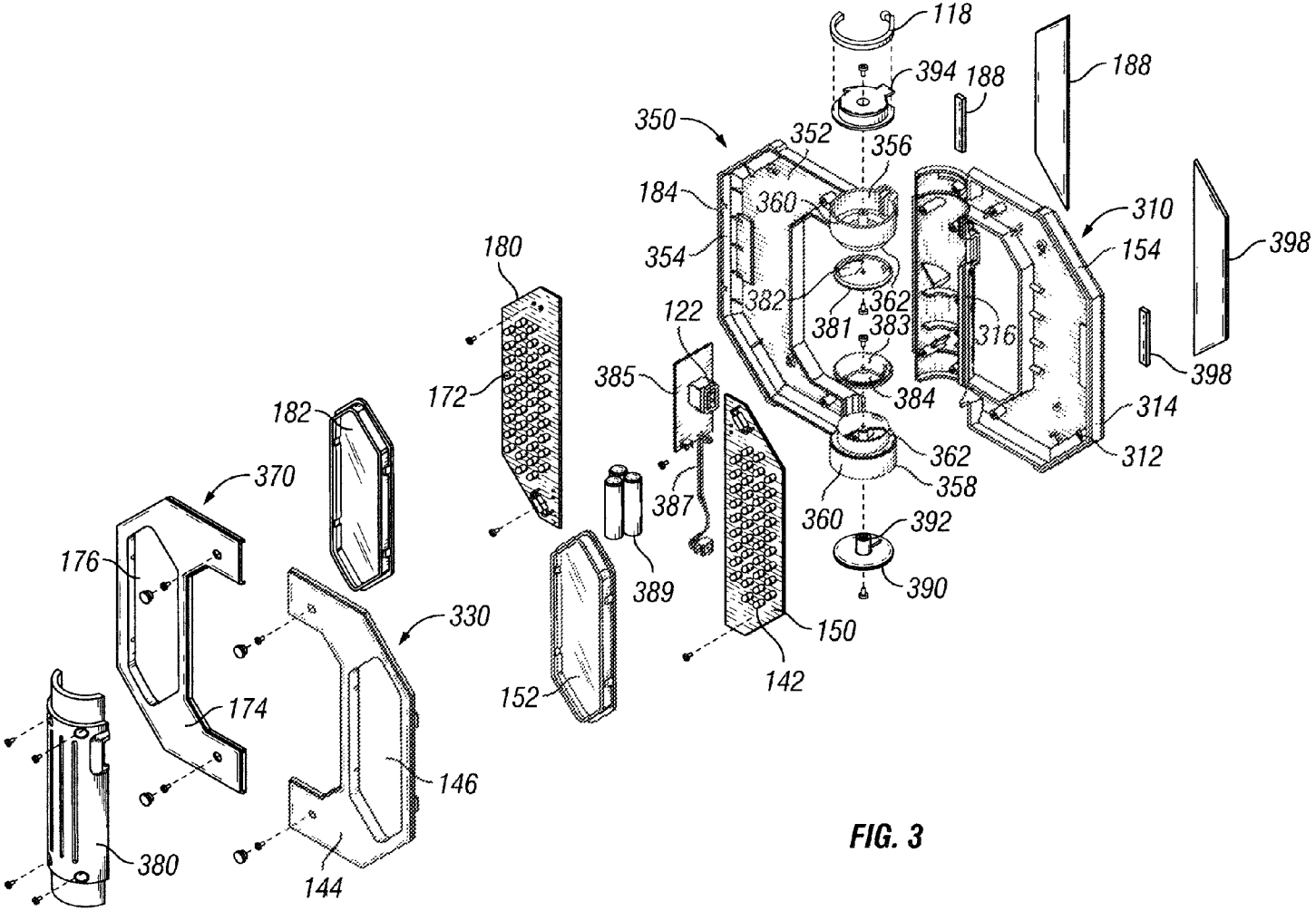
FIG. 3 shows an exploded view of the LED worklight of FIG. 1 in accordance with an exemplary embodiment.

FIG. 3 shows an exploded view of the LED worklight 100 of FIG. 1 in accordance with an exemplary embodiment. According to FIG. 3, the first panel 140 (FIG. 1) includes a first rear panel 310, the first panel circuit board 150 having the first array of LEDs 142 mounted thereon, the first panel lens 152, and a first front panel 330. The first rear panel 310 includes a first rear panel front surface 312, a first rear panel raised wall 314 surrounding the first rear panel front surface 312, the first panel rear side (not shown), and a middle portion rear panel 316 of the inner core 110 coupled to the first rear panel 310. According to this exemplary embodiment, the middle portion rear panel 316 is coupled to the first rear panel 310 at both ends of the middle portion rear panel 316 and is integrally formed with the first rear panel 310. The first rear panel 310 has a similar shape as the first panel 140 (FIG. 1), described above.

The first panel circuit board 150 is coupled to the first rear panel front surface 312 via screws. Although this exemplary embodiment shows the first panel circuit board 150 coupled to the first rear panel front surface 312 via screws, the first panel circuit board 150 can also be coupled to the first rear panel front surface 312 via alternate mounting means including, but not limited to, adhesives and snap mounts.

The first front panel 330 includes the first panel front side 144, a first panel rear side (not shown), and the first panel opening 146 formed therein and extending through the first front panel 330. According to one exemplary embodiment, the first panel lens 152 is coupled to the first panel opening 146 from the first panel rear side (not shown). The first front panel 330 is then coupled to the first rear panel 310, wherein the first panel lens 152 becomes disposed over the first panel circuit board 150 and the first array of LEDs 142. The first front panel 330 has a similar shape as the first panel 140 (FIG. 1), described above. Although the exemplary embodiment shows the first panel lens 152 coupled to the first panel opening 146 from the first panel rear side (not shown), the first panel lens 152 can be coupled to the first panel opening 146 from the first panel front side 144 via mounting means including, but not limited to, adhesives and screws, without departing from the scope and spirit of the present invention. In addition, although the exemplary embodiment shows the first front panel 330 coupled to the first rear panel 310 with screws, the first front panel 330 can also be coupled to the first rear panel 310 with alternate mounting means including, but not limited to, adhesives and snap mounting.

Similarly, according to FIG. 3, the second panel 170 includes a second rear panel 350, the second panel circuit board 180 having the second array of LEDs 172 mounted thereon, the second panel lens 182, and a second front panel 370. The second rear panel 350 includes a second rear panel front surface 352, a second rear panel raised wall 354 surrounding the second rear panel front surface 352, the second panel rear side 178 (FIG. 2), a first rotatable member 356 coupled to the top portion of the second rear panel 350, and a second rotatable member 358 coupled to the bottom portion of the second rear panel 350. According to one exemplary embodiment, the first rotatable member 356 is located at the top of the second rear panel 350 and is open at both ends, while the second rotatable member 358 is located at the bottom of the second rear panel 350 and also is open at both ends. Each of the first rotatable member 356 and the second rotatable member 358 has a large section 360 and a small section 362, where the small section 362 is adjacent the large section 360 and has a smaller circumference than the large section 360. The small section 362 is located entirely within the circumference of the large section 360. According to this exemplary embodiment, the first rotatable member 356 and the second rotatable member 358 are both integrally formed with the second rear panel 350 and form a portion of the first section 112 of the inner core 110 and a portion of the second section 114 of the inner core 110, respectively. Alternatively, the first rotatable member 356 and the second rotatable member 358 may both be integrally formed as part of the first rear panel 310. Alternatively, one of the first rotatable member 356 and the second rotatable member 358 may be integrally formed as part of the second rear panel 350, while the other one is integrally formed as part of the first rear panel 310.

The second panel circuit board 180 is coupled to the second rear panel front surface 352 via screws. Alternatively, the second panel circuit board 180 is coupled to the second rear panel front surface 352 via alternate mounting means including, but not limited to, adhesives and snap mounts.

The second front panel 370 includes the second panel front side 174, a second panel rear side (not shown), and the second panel opening 176 formed therein and extending through the second front panel 370. According to this exemplary embodiment, the second panel lens 182 is coupled to the second panel opening 176 from the second panel rear side (not shown). The second front panel 370 is then coupled to the second rear panel 350, wherein the second panel lens 182 becomes disposed over the second panel circuit board 180 and the second array of LEDs 172. The second front panel 370 has a similar shape as the second panel 170 (FIG. 1), described above. Although this exemplary embodiment shows the second panel lens 182 coupled to the second panel opening 176 from the second panel rear side (not shown), the second panel lens 182 can be coupled to the second panel opening 176 from the second panel front side 174 via mounting means including, but not limited to, adhesives and screws, without departing from the scope and spirit of the present invention. Alternatively, the second front panel 370 is coupled to the second rear panel 350 via alternate mounting means including, but not limited to, adhesives and snap mounting.

The second panel 170 is coupled to the first panel 140 in a manner where the small sections 362 of the first rotatable member 356 and the second rotatable member 358 are positioned within the ends of the middle portion rear panel 316 and the large sections 360 of the first rotatable member 356 and the second rotatable member 358 are positioned exteriorly at the ends of the middle portion rear panel 316.

A first friction ring 381 including a first passageway 382 is coupled to the small section 362 of the first rotatable member 356. The first friction ring 381 has a shape similar to that of the small section 362. In one exemplary embodiment, the first passageway 382 provides a pathway for wires and/or other equipment to pass through. Although this exemplary embodiment shows the first friction ring 381 coupled to the small section 382 via a screw, alternate coupling means, as previously described, can be utilized without departing from the scope and spirit of the present invention. Similarly, a second friction ring 383 having a second passageway 384 is coupled to the small section 362 of the second rotatable member 358. The second friction ring 383 also has a shape similar to that of the small section 362. The second passageway 384 provides a pathway for wires and/or other equipment to pass through. Although this exemplary embodiment shows the second friction ring 383 coupled to the small section 382 via a screw, alternate coupling means, as previously described, can be utilized.

A recharge and switch mounting board 385 and a battery pack 389 are coupled to the interior side of the middle portion rear panel 316. The recharge and switch mounting board 385 includes the switch 122 that extends to the exterior side of the center core 110 (FIG. 1). The battery pack 389 is electrically coupled to the recharge and switch mounting board 385 via a connecting wire 387. In alternative exemplary embodiments, the battery pack 389 includes a rechargeable battery pack or a non-rechargeable battery pack.

A middle portion front panel 380, which is approximately the same length as the middle portion rear panel 316, is coupled to the middle portion rear panel 316 so that the small sections 362 are enclosed between the middle portion front panel 380 and the middle portion rear panel 316. According to FIG. 3, the middle portion front panel 380 is coupled to the middle portion rear panel 316 via screws. However, alternate embodiments may utilize other coupling means known to those of ordinary skill in the art, including some of which have been mentioned above.

A base cap 390 is screw mounted to the opening of the large section 360 of the second rotatable member 358. The base cap 390 includes a direct current ("DC") jack 392 located on the surface of the base cap 390. The DC jack 392 is coupled to the battery pack 389 and recharges the battery pack 389. Although the exemplary embodiment shows the base cap 390 being screw mounted to the opening of the large section 360 of the second rotatable member 358; alternatively, the base cap 390 can be mounted via other known means including, but not limited to, thread mount, clip mount, and pin mount, without departing from the scope and spirit of the exemplary embodiment.

A top cap 394 is screw mounted to the opening of the large section 360 of the first rotatable member 356. In addition, the top cap 394 is coupled to the hook 118, which may be retractable. Although the exemplary embodiment shows the top cap 394 being screw mounted to the opening of the large section 360 of the first rotatable member 356; alternatively, the top cap 394 can be mounted via other known means including, but not limited to, thread mount, clip mount, and pin mount, without departing from the scope and spirit of the exemplary embodiment.

As previously mentioned, the first molding 154 is coupled to at least a portion of the outer perimeter of the first panel rear side (not shown) and over the side edge of the first panel rear side (not shown). The first panel magnet 398 also is coupled to the first panel rear side (not shown) to allow for mounting the LED worklight 100 (FIG. 1) to a ferrous surface. Similarly, the second molding 184 is coupled to at least a portion of the outer perimeter of the second panel rear side 178 (FIG. 2) and over the side edge of the second panel rear side 178 (FIG. 2). The second panel magnet 188 also is coupled to the second panel rear side 178 (FIG. 2) to allow for mounting the LED worklight 100 (FIG. 1) to a ferrous surface. As a result, the LED worklight 100 (FIG. 1) is mountable to two non-planar ferrous surfaces simultaneously.

Figure 4:
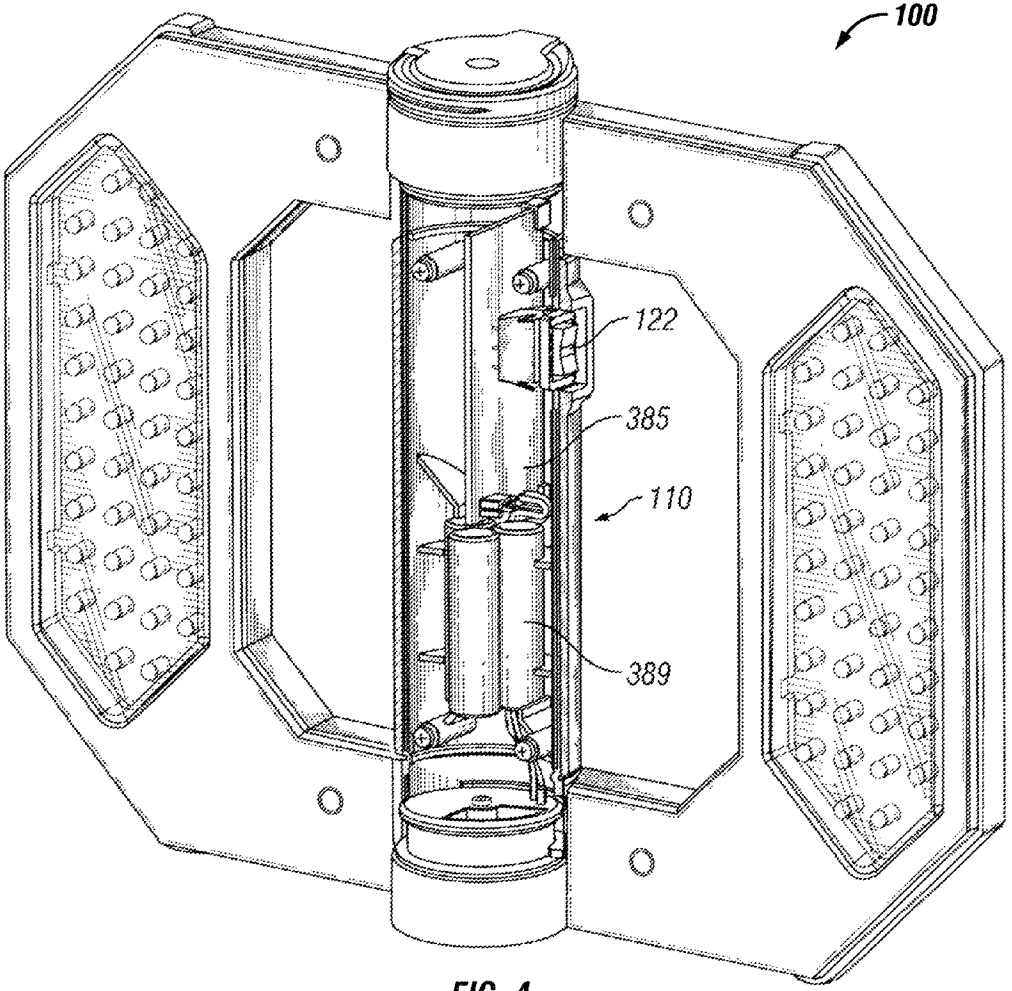
FIG. 4 shows a perspective view of the LED worklight of FIG. 1 having a middle portion front panel removed in accordance with an exemplary embodiment.

FIG. 4 shows a perspective view of the LED worklight 100 of FIG. 1 having a middle portion front panel 380 (FIG. 3) removed in accordance with an exemplary embodiment. The battery pack 389 is located at the bottom portion of the center core 110, while the recharge and switch mounting board 385 is located at the top portion of the center core 110. The battery pack 389, the DC jack 392 (FIG. 3), and the recharge and switch mounting board 385 are all electrically coupled to one another. Additionally, the switch 122 is coupled to the recharge and switch mounting board 385 in a manner where the switch 122 extends to the exterior side of the center core 110. Although this exemplary embodiment shows specific locations for positioning the battery pack 389 and the recharge and switch mounting board 385, these locations vary within the center core 110 without departing from the scope and spirit of the exemplary embodiment.

FIGS. 1-4 collectively illustrate one embodiment of the LED worklight 100. The second panel 170 of the LED worklight 100 is independently rotatable with respect to the first panel 140. The second panel 170 rotates from a 0 degree position, which is a closed configuration, to approximately a 360 degree position. The second panel 170 is positionable at any angle between the 0 degree position and the approximately 360 degree position. Thus, the light output from the first array of LEDs 142 and the light output from the second array of LEDs 172 is independently directed or aimed to a desired area.

Further, when the LED worklight 100 is positioned on a horizontal surface with the first panel 140 and the second panel 170 facing horizontally, the LED worklight 100 illuminates desired work areas including, but not limited to, walls or other generally vertical work surfaces. The first panel 140, the second panel 170, and the center core 110 provide stability to the LED worklight 100 by providing a substantially triangulated mount. Additionally, the LED worklight 100 is positionable horizontally, on a horizontal surface, such that the first panel 140 and the second panel 170 face vertically. In this position, the LED worklight 100 illuminates desired work areas including, but not limited to, ceilings or other generally horizontal work surfaces; for example, the underside of a vehicle. The large flat surfaces of the LED worklight 100 resist changing light output direction due to the inadvertent movement of the LED worklight 100 via the first friction ring 381 and the second friction ring 383. Whether the LED worklight 100 is placed vertically on a horizontal surface or horizontally on a horizontal surface, the second panel 170 is positionable at any angle with respect to the first panel 140.

Figure 6:
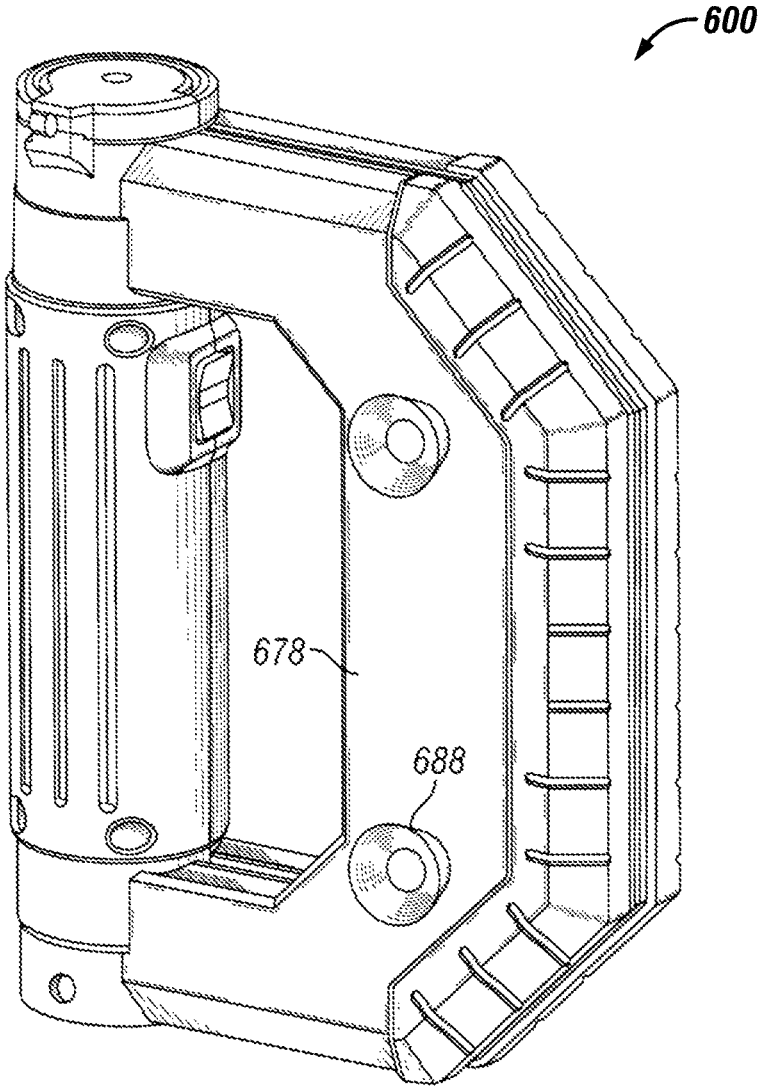
FIG. 6 shows a perspective view of an LED worklight having one or more suction grips in accordance with another exemplary embodiment.

In addition to being capable of mounting to a horizontal surface, the LED worklight 100 is mountable to a vertical surface or to a vertically angling surface. The first panel magnet 398 and the second panel magnet 188 can be magnetically coupled to a vertical or vertically angling surface. In one exemplary embodiment, the LED worklight 100 is mounted to two non-planar surfaces adjacent to one another, where the first panel 140 is mounted to a first surface and the second panel 170 is mounted to a second surface that is non-planar to the first surface. Thus, the LED worklight 100 is mountable to a single surface or to two non-planar surfaces. This mounting feature is particularly useful when working in confined spaces with irregular surfaces, such as the engine bay of an automobile. The use of multiple magnets also allows the LED worklight 100 to be oriented as desired. According to this exemplary embodiment, the vertical or vertically angling surface is fabricated from ferrous material so that the first panel magnet 398 and the second panel magnet 188 couple to it. However, in alternate embodiments, other coupling devices including, but not limited to, suction grips as shown and described in conjunction with FIG. 6, are used so that the LED worklight 100 mounts to non-ferrous vertical and vertically angling surfaces.

Further, the hook 118 provides a mechanism for hanging the LED worklight 100 to a suitable elevated object. According to one exemplary embodiment, hanging the LED worklight 100 by the hook 118 positions the LED worklight 100 in a vertical orientation. In one exemplary embodiment, the hook 118 is retractable, so that the hook 118 retracts into the top cap 394 to reduce potential damage and interference when not in use.

The LED worklight 100 is stored in a manner to protect the first panel lens 152 and the second panel lens 182 from damage. Since the second panel 170 is rotatable, the LED worklight 100 is stored with the second panel 170 positioned in the 0 degree orientation, or closed configuration, in which the first panel lens 152 faces the second panel lens 182. The ability to protect the panel lenses when not in use lengthens the useful life of the LED worklight 100 and provides more freedom for the user when selecting storage locations. Additionally, the LED worklight 100 reduces in width by about 40 percent when the second panel 170 is in the closed orientation, i.e. 0 degree orientation. This reduction in width also provides more freedom to the user when selecting a storage location.

Moreover, the LED worklight 100 provides versatility when operating the first array of LEDs 142 and the second array of LEDs 172, which also extends the battery pack's 389 life. The LED worklight 100 operates alternatively with both the first array of LEDs 142 and the second array of LEDs 172 fully on, the first array of LEDs 142 and the second array of LEDs 172 off, the first array of LEDs 142 on and the second array of LEDs 172 off, the first array of LEDs 142 off and the second array of LEDs 172 on, or either or both of the first array of LEDs 142 and the second array of LEDs 172 being dimmable. This adjustability provides the appropriate amount of light output that is necessary, thereby prolonging the battery pack's 389 life.

FIG. 5 shows a perspective view of an LED worklight 500 in an open configuration in accordance with an alternative exemplary embodiment. In this exemplary embodiment, the LED worklight 500 includes a first panel 540 and a second panel 570. As shown, the first panel 540 and the second panel 570 have a geometric shape that is substantially a filled-in D-shape. Thus, the first air space 159 (FIG. 1) and the second air space 189 (FIG. 1) of LED worklight 100 (Figure) are no longer similarly present in this exemplary embodiment. According to some exemplary embodiments, one of the first panel and the second panel may have an air space similar to the first air space 159 (FIG. 1), while the other panel has no air space.

FIG. 6 shows a perspective view of an LED worklight 600 having one or more suction grips 688 in accordance with another exemplary embodiment. LED worklight 600 includes a first panel rear side (not shown) and a second panel rear side 678. The first panel rear side (not shown) and the second panel rear side 678 include one or more suction grips 688 for mounting the LED worklight 600 to ferrous and/or non-ferrous vertical and vertically angling surfaces. Although two suction grips 688 have been illustrated on the second panel rear side 678, more or less suction grips 688 can be used depending upon the weight of the LED worklight 600.

Figure 7:
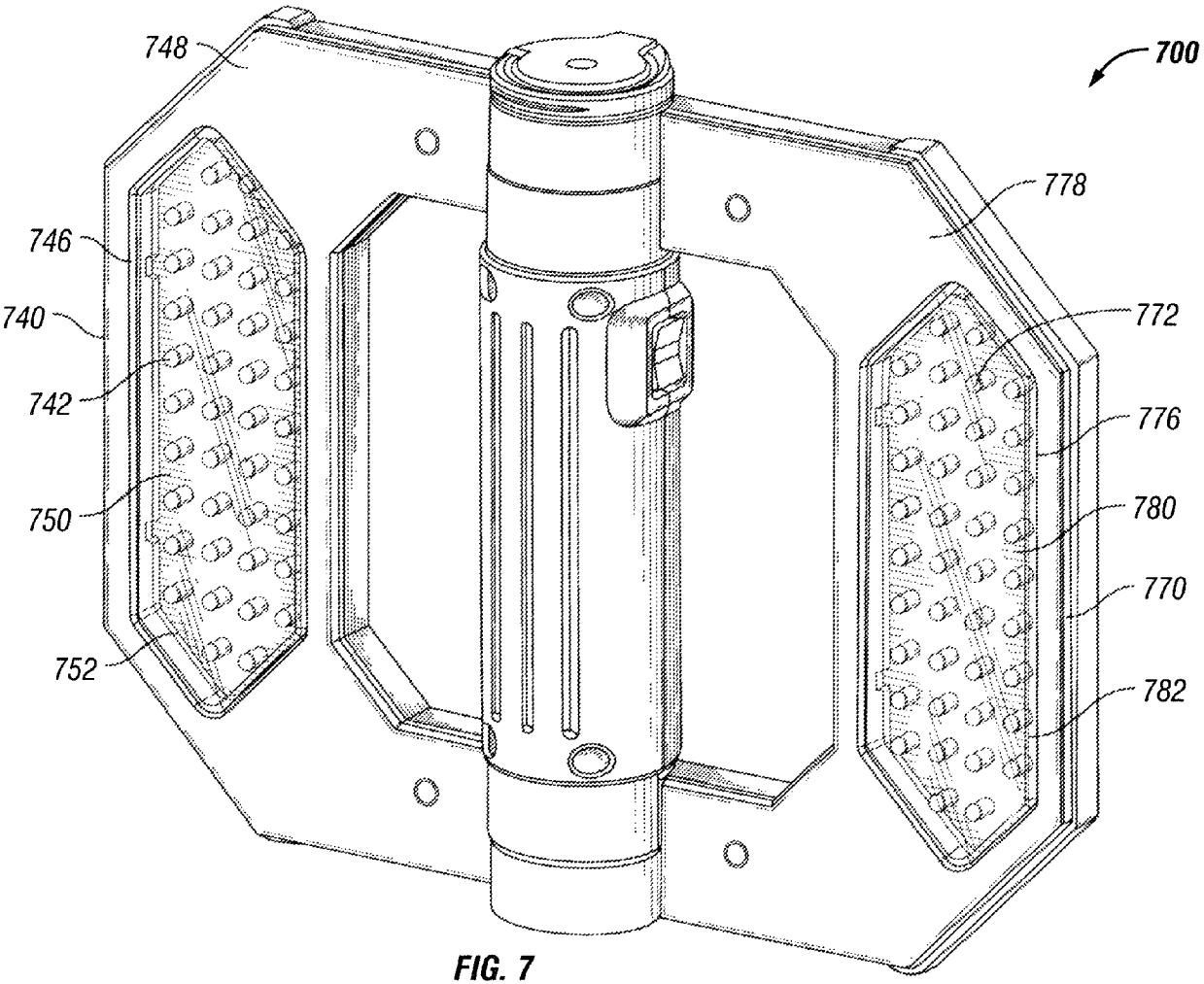
FIG. 7 shows a perspective view of the rear side of an LED worklight in an open configuration in accordance with an alternative exemplary embodiment.

FIG. 7 shows a perspective view of the rear side of an LED worklight 700 in an open configuration in accordance with an alternative exemplary embodiment. The LED worklight 700 includes a first panel 740 having a first panel front side (not shown) and a first panel rear side 748 and a second panel 770 having a second panel front side (not shown) and a second panel rear side 778. In this exemplary embodiment, the first panel rear side 748 is substantially similar to the first panel front side (not shown), which is substantially similar to the first panel front side 144 (FIG. 1) of LED worklight 100 (FIG. 1). The first panel rear side 748 further includes a third panel opening 746 formed therein, a third panel circuit board 750, a third array of LEDs 742, and a third panel lens 752. The third array of LEDs 742 is mounted onto the third panel circuit board 750. The third panel circuit board 750 and the third array of LEDs 742 is coupled to the third panel opening 746 in a similar manner as the first panel circuit board 150 (FIG. 1) and the first array of LEDs 142 (FIG. 1) couple to the first panel opening 146 (FIG. 1). The third panel lens 752 is coupled to the third panel opening 746 and disposed over the third array of LEDs 742. According to certain exemplary embodiments, the third panel lens 752 is transparent, while in alternate embodiments, the third panel lens 752 is tinted any color including, but not limited to, grey, red, and amber. Also, according to certain exemplary embodiments, the third array of LEDs 742 includes one or more white LEDs having a 5 mm dome top and operating at 20 milliamps. Alternative embodiments of the present invention use different types of LEDs or different size LEDs including, but not limited to, colored LEDs. Exemplary colors for the colored LEDs include all non-white colors including, but not limited to, red, green, and amber. The third array of LEDs 742 emits constant, flashing, or dimmable light and is capable of emitting light at various intensities.

Similarly, the second panel rear side 778 is substantially similar to the second panel front side (not shown), which is substantially similar to the second panel front side 174 (FIG. 1) of LED worklight 100 (FIG. 1). The second panel rear side 778 further includes a fourth panel opening 776 formed therein, a fourth panel circuit board 780, a fourth array of LEDs 772, and a fourth panel lens 782. The fourth array of LEDs 772 is mounted onto the fourth panel circuit board 780. The fourth panel circuit board 780 and the fourth array of LEDs 772 are coupled to the fourth panel opening 776 in a similar manner as the second panel circuit board 180 (FIG. 1) and the second array of LEDs 172 (FIG. 1) couple to the second panel opening 176 (FIG. 1). The fourth panel lens 782 is coupled to the fourth panel opening 776 and disposed over the fourth array of LEDs 772. According to certain exemplary embodiments, the fourth panel lens 782 is transparent, while in alternate embodiments, the fourth panel lens 782 is tinted any color including, but not limited to, grey, red, and amber. Also, according to certain exemplary embodiments, the fourth array of LEDs 772 includes one or more white LEDs having a 5 mm dome top and operating at 20 milliamps. Alternative embodiments of the present invention use different types of LEDs or different size LEDs including, but not limited to, colored LEDs. Exemplary colors for the colored LEDs include all non-white colors including, but not limited to, red, green, and amber. The fourth array of LEDs 772 emits constant, flashing, or dimmable light and is capable of emitting light at various intensities.

The third array of LEDs 742 and the fourth array of LEDs 772 are controlled in a manner substantially similar to the first array of LEDs 142 (FIG. 1) and the second array of LEDs 172 (FIG. 1) in that the third array of LEDs 742 and the fourth array of LEDs 772 can both emit light simultaneously, both be turned off, or only one of them emits light at a time. Additionally, as previously mentioned, the third array of LEDs 742 and the fourth array of LEDs 772 emit constant, flashing, or dimmable light.

In yet another alternative embodiment, the first panel rear side (not shown) and the second panel rear side 178 also include one or more reflective devices, or reflective coatings, coupled, or applied, thereon. One example of a reflective device includes a reflective Mylar® tape that adheres to the first panel rear side (not shown) and the second panel rear side 178.

The reflective device and the third array of LEDs and fourth array of LEDs provide a safety feature for the LED worklight 100 when used in low lighting environments, such as roadside repairs on a vehicle during the night.

FIGS. 8-15 show an LED worklight 800, in accordance with certain alternative exemplary embodiments. Referring to FIGS. 8-15, the exemplary LED worklight 800 includes a center core 810, a first panel 840 rotatably coupled to the center core 810, and a second panel 870 rotatably coupled to the center core 810. The first panel 840 includes a first LED die package 842 and the second panel 870 includes a second LED die package 872. In certain alternative exemplary embodiments, the first panel 840 and/or the second panel 870 includes a single LED or an array of LEDS similar to the LED worklight 100 illustrated in FIGS. 1-7 and discussed above. The LED die packages 842, 872 can include LEDs that emit the same color or different colors of light. Exemplary colors emitted by the LED die packages 842 and 872 include white and all non-white colors including, but not limited to, red, green, blue, and amber. Additionally, both LED die packages 842, 872 are capable of emitting constant, flashing on and off, or dimmable light. In certain exemplary embodiments, the LED worklight 800 is portable.

The center core 810 includes a first section 812, a second section 814, and a middle section 816 located between the first section 812 and the second section 814. In certain exemplary embodiments, the center core 810 is fabricated at least partially by portions of the first panel 840 and the second panel 870, similar to the center core 110 of FIG. 1. In certain exemplary embodiments, the first section 812, the second section 814, and the middle section 816 have a substantially cylindrical shape. Although the middle section 816 has been illustrated with a substantially cylindrical shape, the middle section 816 may be any geometric or non-geometric shape, including triangular, rectangular, or hexagonal, without departing from the scope and spirit of the present invention. In certain exemplary embodiments, the center core 810 is fabricated from any suitable material including, but not limited to, plastics, rubber, polymers, metals, and metal alloys.

The first section 812 further includes a push button switch 822 for controlling the first and second LED die packages 842, 872. In certain exemplary embodiments, the switch 822 is operated to select between two settings—(a) both LED die packages on or (b) both LED die packages 842, 872 off. In certain other exemplary embodiments, the switch 822 is operated to select between three settings—(a) one LED die package on, (b) both LED die packages on, or (c) both LED die packages 842, 872 off. In yet another exemplary embodiment, the switch is operated to select between four settings, (a) both LED die packages on, (b) the first LED die package 842 on and the second LED die package 872 off, (c) the first LED die package 842 off and the second LED die package 872 on, and (d) both LED die packages 842, 872 off. In the exemplary embodiment having three settings, one manner of accomplishing this is as follows: if both LED die packages are deactivated, pressing the push button switch 822 once activates one LED die package and pressing the push button switch 822 a second time activates both LED die packages. Pressing the push button switch 822 a third time deactivates both LED die packages.

In certain exemplary embodiments, the switch 822 is any type of switch known to persons of ordinary skill in the art, including, but not limited to, a push-button switch, a sliding switch and a rocking switch, without departing from the scope and spirit of the present invention. In certain exemplary embodiments, the switch 822 is positioned on the exterior center core 810 and at an end of the first section 812. Although one switch 822 has been illustrated, certain alternative exemplary embodiments may include multiple switches, with each switch controlling one LED die package 842, 872. For example, a switch for controlling the first LED die package 842 may be positioned along or at an end of the first section 812 and a switch for the second LED die package 872 may be positioned along or at an end of the second section 814.

The center core 810 houses several components, including a supporting structure (not shown) for the switch 822 and a power source (not shown). In certain exemplary embodiments, the power source includes a battery pack (not shown). The battery pack can include a non-rechargeable battery pack or a rechargeable battery pack. In certain exemplary embodiments, the power source includes one or more rechargeable batteries. In certain exemplary embodiments, the power source includes one or more disposable batteries. The power source is electrically coupled to the switch 822 via one or more electrical conductors (not shown). The switch 822, in turn, is electrically coupled to the LED die packages 842, 872 via one or more electrical conductors (not shown). The center core 810 also includes a door 817 for accessing the battery pack.

The center core 810 also includes several finger grooves 818*a*-818*c* and 819*a*-819*c* (FIG. 11) that collectively provide a gripping mechanism so that an operator can easily grip the LED worklight 800. In addition or in the alternative, the center core 810 can include a grip (not shown) coupled circumferentially around at least a portion of the middle section 816, similar to the grip 120 illustrated in FIGS. 1 and 2 and discussed above.

The first panel 840 includes a first panel front side 844 having a first panel opening 846 formed therein, a first panel rear side 878 (FIG. 11), and the first LED die package 842. The first LED die package 842 is releasably coupled to the first panel opening 846. According to this exemplary embodiment, the first LED die package 842 is disposed within the first panel opening 846. In certain alternative exemplary embodiments, the first LED die package 842 is coupled to the surface of the first panel 840. Although the first panel opening 846 has been illustrated having a substantially rectangular-shaped appearance, other shapes and sizes of the first panel opening 846 are within the scope of the present invention including, but not limited to, hexagonal, square, oval, and diamond-shaped.

The first panel 840 further includes a first panel lens 852 coupled to the first panel 840 along the edge of the first panel opening 846 and disposed over the first LED die package 842. In certain exemplary embodiments, the first panel lens 852 has the same geometric shape as the first panel opening 846; however, this is not necessary. In certain exemplary embodiments, the first panel lens 852 is transparent. In alternative embodiments, the first panel lens 852 is prismatic or frosted to obscure the view of the first LED die package 842. In certain alternative exemplary embodiments, the first panel lens 852 is tinted any color including, but not limited to, green, red, and amber. The first panel lens 852 is fabricated from a plastic material, a glass material, or any other translucent material. The first panel lens 852 acts as a protective cover for the first LED die package 842. Additionally, certain exemplary embodiments utilize the first panel lens 852 to direct or diffuse the light output from the first LED die package 852 according to a desired pattern. In certain exemplary embodiments, the first panel lens 852 is about 2 mm thick. However, the thickness of the first panel lens 852 can be more or less without departing from the scope and spirit of the present invention.

The combination of the first panel 840 and the center core 810 define a first opening through the LED worklight 800. According to one exemplary embodiment, the first panel 840 is substantially C-shaped, thereby forming a first air space 859 between a substantial portion of the first panel 840 and the center core 810. In this embodiment, the center core 810 functions as a handle. Although the first panel 840 has been illustrated as being C-shaped, the first panel 840 can be of any geometric shape without departing from the scope and spirit of the present invention. An example of one geometric shape of the first panel 840 is illustrated and described in conjunction with FIG. 5.

The first panel 840 further includes additional apertures or holes 834 and 835 formed therein that extend through first panel 840. The holes 834 and 835 reduce the amount of material required to fabricate the first panel 840 and also reduce the overall weight of the LED worklight 800. The holes 834 and 835 also can be used to hang or suspend the LED worklight 800 from an object, such as a nail, hook, or other exposed object. Although the holes 834 and 835 have been illustrated as having a substantially triangular shape, the holes 834 and 835 can be of any geometric or non-geometric shape without departing from the scope and spirit of the present invention. In addition, the first panel 840 can include more or less than two holes without departing from the scope and spirit of the present invention.

Figure 9:
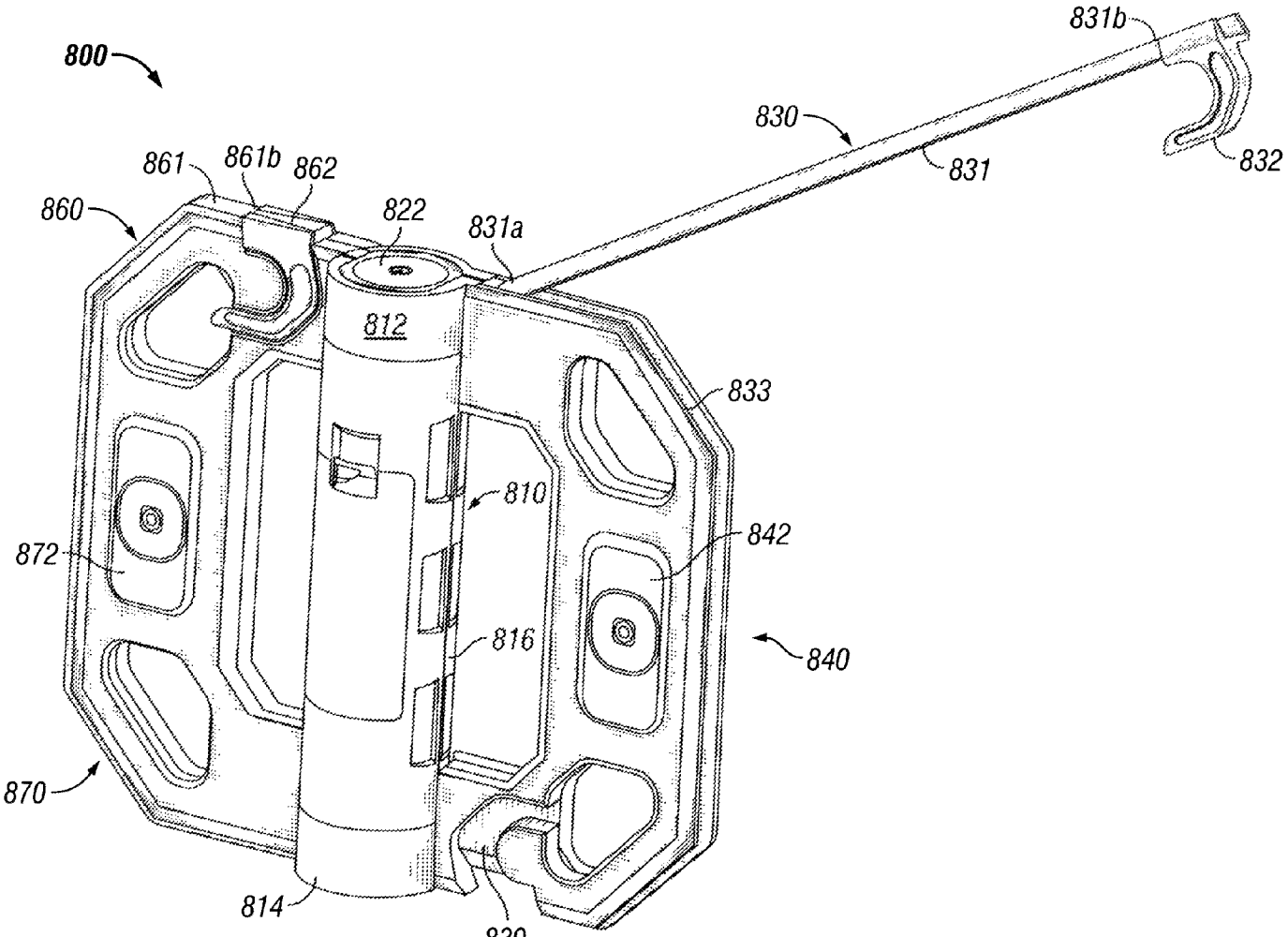
FIG. 9 shows a perspective view of the LED worklight of FIG. 8 in an open configuration with an elastic band having a hook extending from the worklight, in accordance with an exemplary embodiment.
Figure 10:
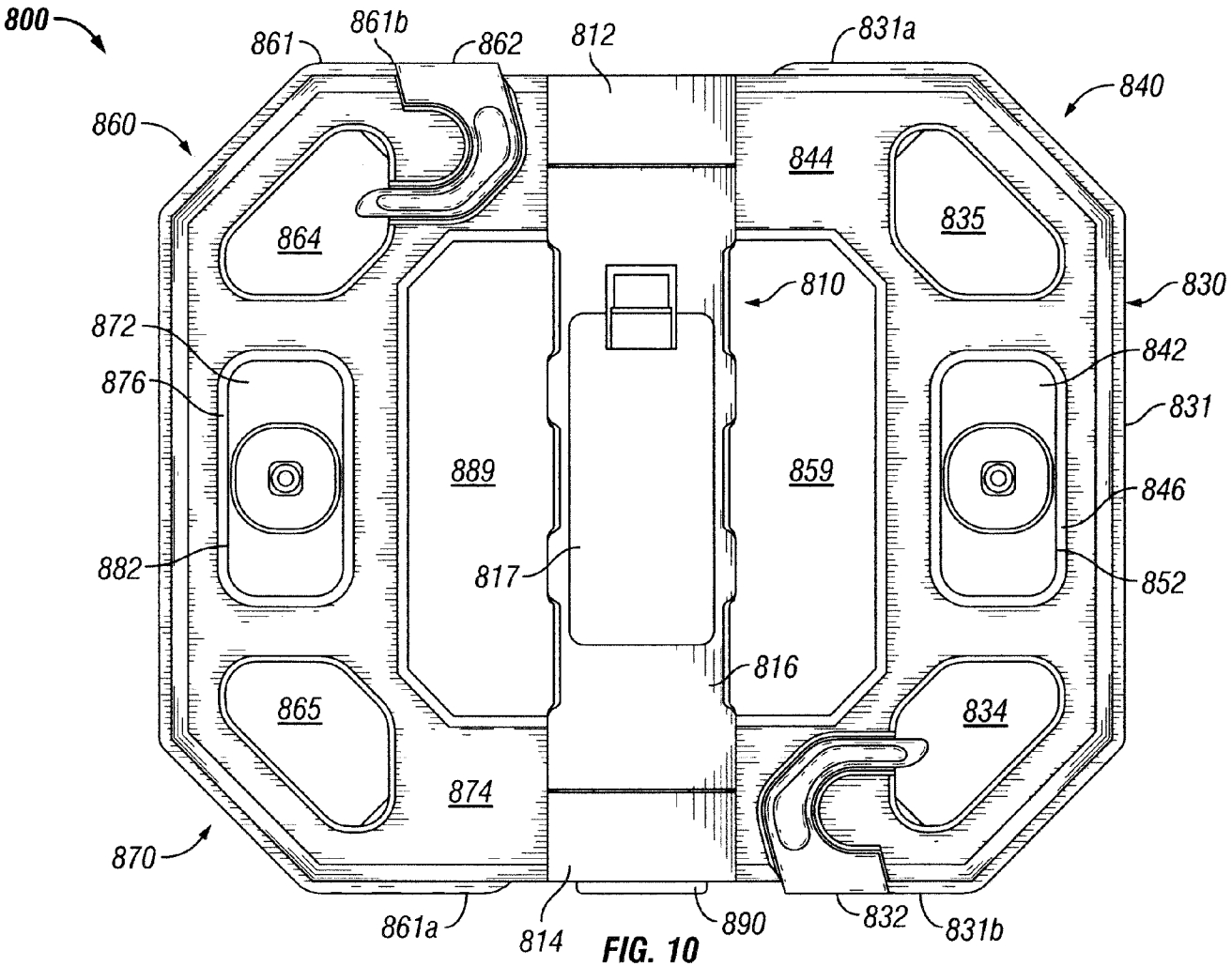
FIG. 10 shows a front elevation view of the LED worklight of FIG. 8 in an open configuration, in accordance with an exemplary embodiment.

As best seen in FIG. 9, the first panel 840 further includes a first attachment mechanism 830 coupled thereto. The first attachment mechanism 830 is used to hang the LED worklight 800 from, or to attach the LED worklight 800 to, an object. Alternatively, the first attachment mechanism is coupled to another attachment mechanism, as will be discussed hereinafter. The exemplary first attachment mechanism 830 includes an elastic or semi-elastic band 831 that is coupled to the first panel 840 at a first end 831*a* and has a hook 832 or other coupling device coupled to a second end 831*b*. In certain exemplary embodiments, the elastic band 831 is fabricated from any suitable elastic material including, but not limited to, plastics, rubbers, polymers, and other types of materials or combinations of materials known to persons of ordinary skill in the art having the benefit of the present disclosure. Although the elastic band 831 is discussed herein as being elastic or semi-elastic, other elongated members having elastic or non-elastic qualities may also be used with the LED worklight 800 as would be appreciated by one or ordinary skill in the art having the benefit of the present disclosure. Exemplary applications of the first attachment mechanism 840 are described below.

Figure 8:
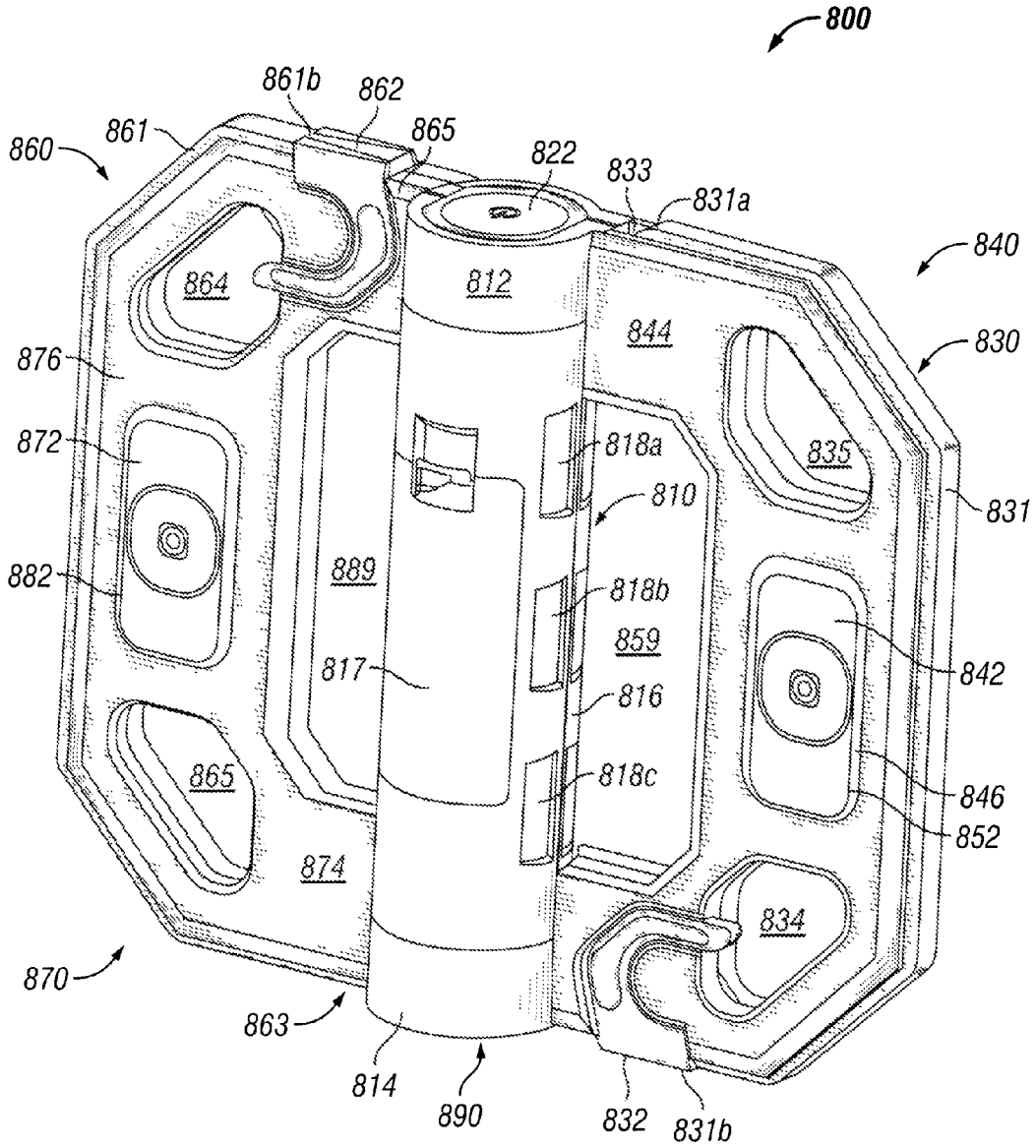
FIG. 8 shows a perspective view of an LED worklight in an open configuration, in accordance with an exemplary embodiment.

The first panel 840 further includes a semi-recessed channel 833 disposed along an outer perimeter of the first panel 840 for receiving and storing the elastic band 831. The channel 833 stores the elastic band 831 such that the elastic band 831 does not interfere with the operation of the LED worklight 800 when the first attachment mechanism 830 is not in use. According to one exemplary embodiment, as best seen in FIG. 8, the elastic band 831 is slidably inserted or press-fitted into the channel 833. The exemplary elastic band 831 has a thickness greater than the depth of the channel 833, which allows a portion of the elastic band 831 to protrude from the channel 833. In such an embodiment, the elastic band 831 also acts as a cushion to absorb impacts during use, for example if the LED worklight 800 is dropped or if a hand tool strikes the LED worklight 800.

In certain exemplary embodiments, the elastic band 831 is coupled to a pin (not shown) located in the channel 833 and attached to the first panel 840. The pin extends across the width of the channel 833 perpendicular to the elastic band 831. In certain exemplary embodiments, the first end 831*a* of the elastic band 831 encircles the pin such that the elastic band 831 is free to rotate around the pin. In certain exemplary embodiments, other mechanisms can be used to attach the elastic band 831 to the first panel 840 without departing from the scope and spirit of the present invention.

The hook 832 can be a rigid or semi-rigid hook and can be fabricated from any suitable material including, but not limited to, plastics, rubbers, polymers, metals, and metal alloys. In certain alternative embodiments, other types of devices can be coupled to the second end 831*b* of the elastic band 831 for use in attaching the LED worklight 800 to another object including, but not limited to, magnets, suctions cups, carabiners, and rigid or semi-rigid devices having a shape alternative to a hook, such as a T-shaped device. The first panel 840 includes an area 839 for storing the hook 832 when the first attachment mechanism 830 is not in use. In certain exemplary embodiments, the area 839 is formed to match or substantially match the shape of the hook 832 (or other device attached to the end 831*b* of the elastic band 831) and the hook 832 is slidably inserted or press-fitted into the area 839. In an alternative embodiment, the hook 832 includes a magnet (not shown) and the interior of the area 839 includes a ferrous surface or other magnet having an opposite polar charge. In certain exemplary embodiments, the area 839 has a depth equal to or greater than the thickness of the hook 832. Thus, the area 839 can store the entire depth of the hook 832 without any portion thereof protruding from the surface of the first panel front side 844. This allows the LED worklight 800 to fully open and close without interference from the hook 832. In the illustrated embodiment, a portion of the hook 832 extends into the hole 834. This aids in removing the hook 832 from the area 839. In certain alternative exemplary embodiments, the area 839 or the hook 832 may be sized (or otherwise configured) such that the hook 832 does not extend into the space saver hole 834.

Figure 11:
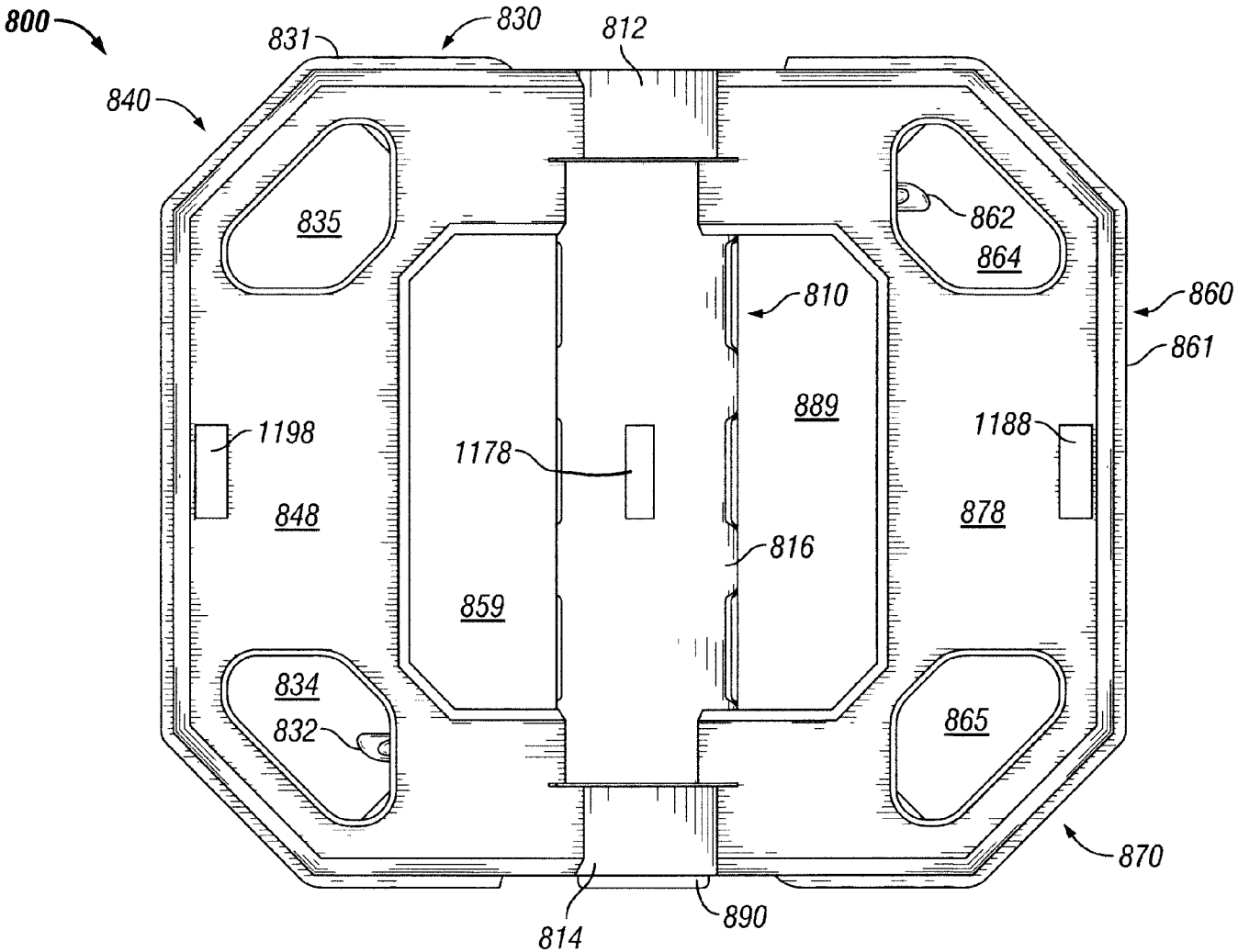
FIG. 11 shows a rear elevation view of the LED worklight of FIG. 8 in an open configuration, in accordance with an exemplary embodiment.
Figure 12:
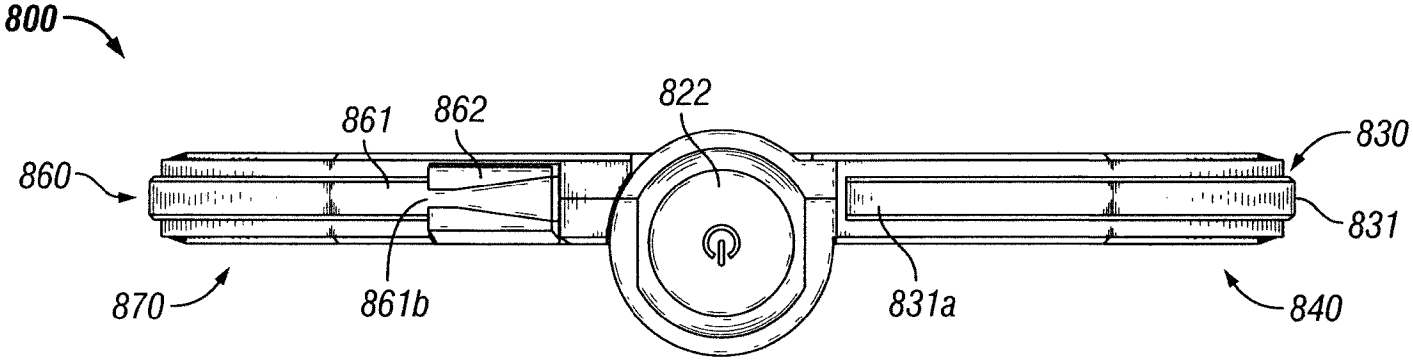
FIG. 12 shows a top plan view of the LED worklight of FIG. 8, in an open configuration, in accordance with an exemplary embodiment.
Figure 13:
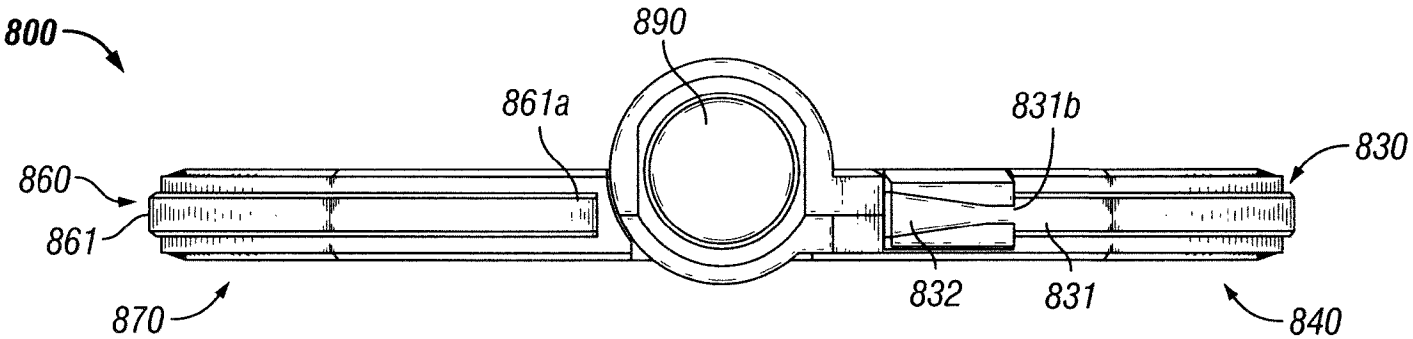
FIG. 13 shows a bottom plan view of the LED worklight of FIG. 8 in an open configuration, in accordance with an exemplary embodiment.
Figure 14:
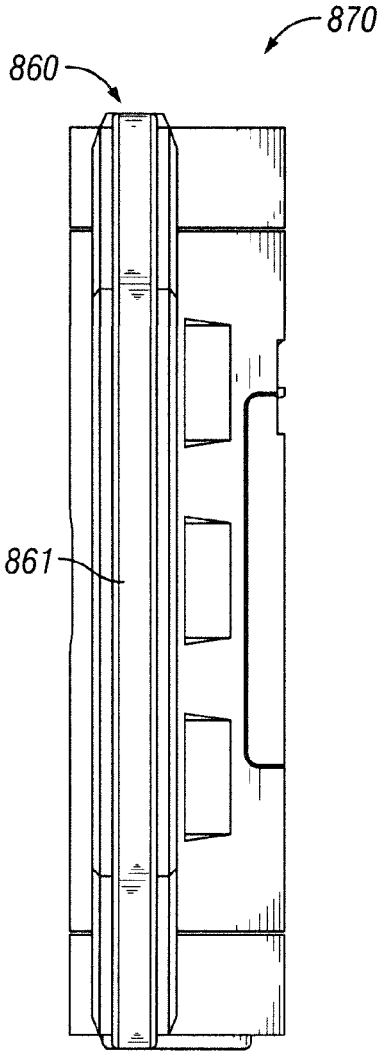
FIG. 14 shows a side elevation view of the LED worklight of FIG. 8 in an open configuration, in accordance with an exemplary embodiment.
Figure 15:
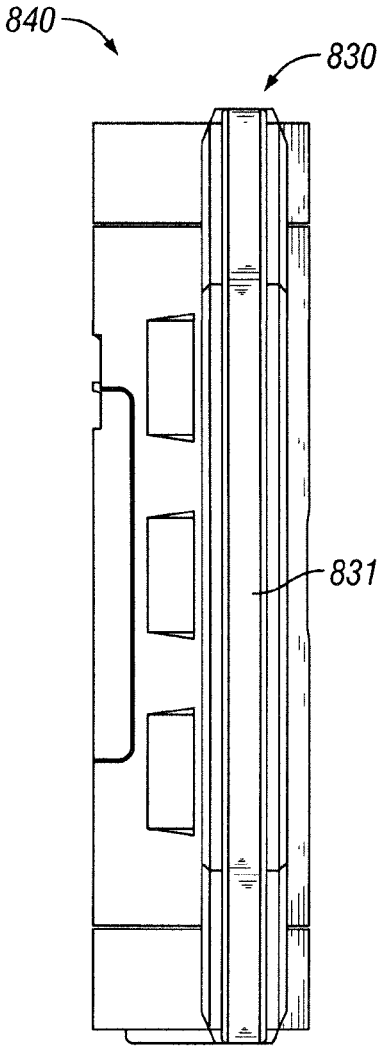
FIG. 15 shows another side elevation view of the LED worklight of FIG. 8 in an open configuration, in accordance with an exemplary embodiment.

As best seen in FIG. 11, the first panel rear side 848 is substantially similar to the front panel front side 874. However, in this exemplary embodiment, the first panel rear side 848 does not include an LED die package, a panel opening for coupling an LED die package to the first panel rear side 848, or a lens. In certain alternative embodiments, the first panel rear side 848 does include a panel opening having an LED die package (or other type of lamp) disposed therein and a lens coupled to the first panel rear side 848 and disposed over the LED die package.

The first panel rear side 848 includes at least one first panel magnet 1198 coupled thereon. This at least one first panel magnet 1198 allows the first panel 840 to be coupled to a ferrous surface. As shown in FIG. 11, the center core 810 also includes at least one magnet 1178. This at least one magnet 1178 allows the center core 810 of the LED worklight 800 to be coupled to a ferrous surface, which may be the same planar ferrous surface that the first panel 840 couples to or a ferrous surface that is adjacent to and angled with respect to the ferrous surface that the first panel 840 couples to. Although magnets have been illustrated in this embodiment, other devices may be used to couple the first panel 840 and the center core 810 to ferrous and/or non-ferrous surface including, but not limited to, suctions grips as shown and described in conjunction with FIG. 6, without departing from the scope and spirit of the present invention.

Similarly, the second panel 870 includes a second panel front side 874 having a second panel opening 876 formed therein, a second panel rear side 878, and the second LED die package 872. The second LED die package 872 is releasably coupled to the second panel opening 876. According to this exemplary embodiment, the second LED die package 872 is disposed within the second panel opening 876. In certain alternative exemplary embodiments, the second LED die package 872 is coupled to the surface of the second panel 870. Although the second panel opening 876 has been illustrated having a substantially rectangular-shaped appearance, other shapes and sizes of the first panel opening 876 are within the scope of the present invention including, but not limited to, hexagonal, square, oval, and diamond-shaped.

The second panel 870 further includes a second panel lens 872 coupled to the second panel 870 along the edge of the second panel opening 876 and disposed over the second LED die package 872. In certain exemplary embodiments, the second panel lens 872 has the same geometric shape as the second panel opening 876; however, this is not necessary. In certain exemplary embodiments, the second panel lens 872 is transparent. In alternative embodiments, the second panel lens 872 is prismatic or frosted to obscure the view of the first LED die package 872. In certain alternative exemplary embodiments, the second panel lens 872 is tinted any color including, but not limited to, green, red, and amber. The second panel lens 872 is fabricated from a plastic material, a glass material, or any other translucent material. The second panel lens 872 acts as a protective cover for the second LED die package 872. Additionally, certain exemplary embodiments utilize the second panel lens 872 to direct or diffuse the light output from the second LED die package 872 according to a desired pattern. In certain exemplary embodiments, the second panel lens 872 is about 2 mm thick. However, the thickness of the first panel lens 872 can be more or less without departing from the scope and spirit of the present invention.

The combination of the second panel 870 and the center core 810 define a second opening through the LED worklight 800. According to one exemplary embodiment, the second panel 870 is substantially C-shaped, thereby forming a second air space 889 between a substantial portion of the second panel 870 and the center core 810. In this embodiment, the center core 810 functions as a handle. Although the second panel 870 has been illustrated as being C-shaped, the second panel 870 can be of any geometric shape without departing from the scope and spirit of the present invention. An example of one geometric shape of the second panel 870 is illustrated and described in conjunction with FIG. 5.

The second panel 870 further includes additional apertures or holes 864 and 865 formed therein. The holes 864 and 865 reduce the amount of material required to fabricate the second panel 870 and also reduce the overall weight of the LED worklight 800. The holes 864 and 865 also can be used to hang or suspend the LED worklight 800 from an object, such as a nail, hook, or other exposed object. Although the holes 864 and 865 have been illustrated as having a substantially triangular shape, the space saver holes 864 and 865 can be of any geometric or non-geometric shape without departing from the scope and spirit of the present invention. In addition, the second panel 870 can include more or less than two space saver holes without departing from the scope and spirit of the present invention.

As best seen in FIG. 9, the second panel 870 further includes a second attachment mechanism 860 coupled thereto. The second attachment mechanism 860 is used to hang the LED worklight 800 from, or to attach the LED worklight 800 to, an object. Alternatively, the second attachment mechanism 860 is coupled to another attachment mechanism, as will be discussed hereinafter. The exemplary second attachment mechanism 860 includes an elastic or semi-elastic band 861 that is coupled to the second panel 870 at a first end 861*a* and has a hook 862 or other coupling device coupled to a second end 861*b*. In certain exemplary embodiments, the elastic band 861 is fabricated from any suitable elastic material including, but not limited to, plastics, rubbers, polymers, and other types of materials or combinations of materials known to persons of ordinary skill in the art having the benefit of the present disclosure. Although the elastic band 861 is discussed herein as being elastic or semi-elastic, other elongated members having elastic or non-elastic qualities may also be used with the LED worklight 800 as would be appreciated by one or ordinary skill in the art having the benefit of the present disclosure. Exemplary applications of the second attachment mechanism 860 are described below.

The second panel 870 further includes a semi-recessed channel 863 disposed along an outer perimeter of the second panel 870 for receiving and storing the elastic band 861. The channel 863 stores the elastic band 861 such that the elastic band 861 does not interfere with the operation of the LED worklight 800 when the second attachment mechanism 860 is not in use. According to one exemplary embodiment, as best seen in FIG. 8, the elastic band 861 is slidably inserted or press-fitted into the channel 863. The exemplary elastic band 861 has a thickness greater than the depth of the channel 863, which allows a portion of the elastic band 861 to protrude from the channel 863. In such an embodiment, the elastic band 861 also acts as a cushion to absorb impacts during use, for example if the LED worklight 800 is dropped or if a hand tool strikes the worklight 800.

In certain exemplary embodiments, the elastic band 861 is coupled to a pin (not shown) located in the channel 863 and attached to the second panel 870. The pin extends across the width of the channel 863 perpendicular to the elastic band 861. In certain exemplary embodiments, the first end 861*a* of the elastic band 861 encircles the pin such that the elastic band 861 is free to rotate around the pin. In certain exemplary embodiments other mechanisms can be used to attach the elastic band 861 to the first panel 870 without departing from the scope and spirit of the present invention.

The hook 862 can be a rigid or semi-rigid hook and can be fabricated from any suitable material including, but not limited to, plastics, rubbers, polymers, metals, and metal alloys. In certain alternative embodiments, other types of devices can be coupled to the second end 861*b* of the elastic band 861 for use in attaching the LED worklight 800 to another object including, but not limited to, magnets, suctions cups, carabiners, and rigid or semi-rigid devices having a shape alternative to a hook, such as a T-shaped device. The second panel 840 includes an area 869 (FIG. 16) for storing the hook 862 when the second attachment mechanism 860 is not in use. In certain exemplary embodiments, the area 869 is formed to match or substantially match the shape of the hook 862 (or other device attached to the end 861*b* of the elastic band 861) and the hook 862 is slidably inserted or press-fitted into the area 869. In an alternative embodiment, the hook 862 includes a magnet (not shown) and the interior of the area 869 includes a ferrous surface or other magnet having an opposite polar charge. In certain exemplary embodiments, the area 869 has a depth equal to or greater than the thickness of the hook 862. Thus, the area 869 can store the entire depth of the hook 862 without any portion thereof protruding from the surface of the second panel front side 874. This allows the LED worklight 800 to fully open and close without interference from the hook 862. In the illustrated embodiment, a portion of the hook 862 extends into the space saver hole 864. This aids in removing the hook 862 from the area 869. In certain alternative exemplary embodiments, the area 869 or the hook 862 may be sized (or otherwise configured) such that the hook 862 does not extend into the space saver hole 864.

As best seen in FIG. 11, the second panel rear side 878 is substantially similar to the second panel front side 874. However, in this exemplary embodiment, the second panel rear side 878 does not include an LED die package, a panel opening for coupling an LED die package to the first panel rear side 878, or a lens. In certain alternative embodiments, the second panel rear side 878 does include a panel opening having an LED die package (or other type of lamp) disposed therein and a lens coupled to the second panel rear side 878 and disposed over the LED die package. LED die packages mounted on the front panel rear side 848 and on the second panel rear side 878 are controlled by a switch, such as switch 822, in a manner substantially similar to the first LED die package 842 and the second LED die package 872 in that both rear mounted LED die packages can both emit light simultaneously, both be turned off, or only one of them emits light at a time. Additionally, the rear mounted LED die packages emit constant, flashing, or dimmable light.

The second panel rear side 878 includes at least one second panel magnet 1188 coupled thereon. This at least one magnet 1188 allows the second panel 870 of the LED worklight 800 to be coupled to a ferrous surface, which may be the same planar ferrous surface that the first panel 840 couples to or a ferrous surface that is adjacent to and angled with respect to the ferrous surface that the first panel 840 couples to. Although magnets have been illustrated in this embodiment, other devices may be used to couple the second panel 870 to ferrous and/or non-ferrous surface including, but not limited to, suctions grips as shown and described in conjunction with FIG. 6, without departing from the scope and spirit of the present invention.

Although not shown, the LED worklight 800 includes many of the same or similar components to those illustrated in the exploded view of the LED worklight 100 of FIG. 1. In certain exemplary embodiments, the first panel 840 includes a first rear panel (not shown) and a first front panel (not shown), similar to the first rear panel 310 and the first front panel 330. However, the first front panel and the first rear panel of the first panel 840 each have a similar shape as the first panel 840, including the two holes 834 and 835 formed therein and extending through each of the panels. The first rear panel includes a first rear panel front surface (not shown), a first rear panel raised wall (not shown) surrounding the first rear panel front surface, the first panel rear side 848, and a middle portion rear panel (not shown) of the inner core 810 coupled to the first rear panel. In certain exemplary embodiments, the middle portion rear panel is coupled to the first rear panel at both ends of the middle portion rear panel and is integrally coupled with the first rear panel. In certain exemplary embodiments, the LED die package 842 is coupled to the first rear panel front surface via screws, adhesives, snap mounts, or other mounting means.

The first front panel of the of the first panel 840 includes the first panel front side 844, a first panel rear side (not shown), and the first panel opening 846 and the holes 834 and 835 formed therein and extending through the first front panel. According to one exemplary embodiment, the first panel lens 852 is coupled to the first panel opening 846 from the first panel rear side (not shown). The first front panel is then coupled to the first rear panel, wherein the first panel lens 852 becomes disposed over the first LED die package 842. The first front panel is coupled to the first rear panel with screws, adhesives, snap mounting, other mounting means. In certain exemplary embodiments, the first panel lens 852 is coupled to the first panel opening 846 from the first panel front side 844 via mounting means including, but not limited to, adhesives and screws.

Similarly, the second panel 870 includes a second rear panel (not shown) and a second front panel (not shown), similar to the second rear panel 350 and the second front panel 370. However, the second front panel and the second rear panel of the second panel 870 each have a similar shape as the second panel 870, including the two holes 834, 835 formed therein and extending through each of the panels. The second rear panel includes a second rear panel front surface (not shown), a second rear panel raised wall (not shown) surrounding the second rear panel front surface, the second panel rear side 878, a first rotatable member (not shown) coupled to the top portion of the second rear panel, and a second rotatable member (not shown) coupled to the bottom portion of the second rear panel. The first rotatable member and second rotatable member of the second panel 870 are substantially the same or similar to first rotatable member 356 and the second rotatable member 358 illustrated in FIG. 3, respectively. In addition, the first rotatable member and second rotatable member of the second panel 870 can be formed and configured substantially the same as the first rotatable member 356 and the second rotatable member 358, respectively.

In certain exemplary embodiments, the LED die package 872 is coupled to the second rear panel front surface via screws, adhesives, snap mounts, or other mounting means. The second front panel of the of the second panel 870 includes the second panel front side 874, a second panel rear side (not shown), and the second panel opening 876 and the holes 864, 865 formed therein and extending through the first front panel. According to one exemplary embodiment, the second panel lens 882 is coupled to the second panel opening 876 from the first panel rear side (not shown). The second front panel is then coupled to the second rear panel, wherein the second panel lens 882 becomes disposed over the second LED die package 872. The second front panel is coupled to the first rear panel with screws, adhesives, snap mounting, other mounting means. In certain exemplary embodiments, the second panel lens 882 is coupled to the second panel opening 876 from the second panel front side 874 via mounting means including, but not limited to, adhesives and screws.

In certain exemplary embodiments, the LED worklight 800 also includes a first friction ring (not shown) similar to the first friction ring 381 of the LED worklight 100. This first friction ring includes a first passageway (not shown) and is coupled to the small section (not shown) of the first rotatable member of the second panel 870. This first passageway provides a pathway for wires and/or other equipment to pass through. In certain exemplary embodiments, this first friction ring has a shape similar to that of the small section of the first rotatable member.

In certain exemplary embodiments, the LED worklight 800 includes a second friction ring similar to the second friction ring 383 of the LED worklight 100. This second friction ring includes a second passageway (not shown) and is coupled to the small section (not shown) of the second rotatable member of the second panel 870. This second passageway provides a pathway for wires and/or other equipment to pass through. In certain exemplary embodiments, this second friction ring has a shape similar to that of the small section of the second rotatable member.

The LED worklight 800 also includes a base cap 890, similar to the base cap 390 of the LED worklight 100. In certain exemplary embodiments, the base cap 890 is screw mounted to an opening of the large section (not shown) of the second rotatable member of the second panel 870. In certain rechargeable battery and/or rechargeable battery pack embodiments, the base cap 890 includes a DC jack (not shown) located on the surface of the base cap 890. The DC jack is coupled to the battery or battery pack of the LED worklight 800 and recharges the battery pack. In certain exemplary embodiments, rather than being screw mounted, the base cap 890 is mounted via thread mount, clip mount, pin mount, or other known means without departing from the scope and spirit of the present invention.

According to one exemplary embodiment, the LED worklight 800 is about 10" from the top of the first section 812 to the bottom of the second section 814 and about 12" wide when the first panel 840 and the second panel 870 are oriented 180 degrees apart in the open configuration. The first panel 840 and the second panel 870 are approximately ¾" thick. Additionally, the center core 810 has about a 2" diameter. Although exemplary dimensions have been provided for the LED worklight 800, the dimensions are capable of being modified either up or down without departing from the scope and spirit of the present invention.

The following is a description of the adjustability of the LED worklight 800. While the adjustability is described with regard to the second panel 870, it could alternatively be the first panel 840 that is adjusted in the same manner. The second panel 870 of the LED worklight 800 is independently rotatable with respect to the first panel 840. The second panel 870 rotates from a 0 degree position, which is the closed configuration, to approximately a 359 degree position. The second panel 870 is positionable at any angle between the 0 degree position and the approximately 359 degree position. Thus, the light output from the first LED die package 842 and the light output from the second LED die package 872 is independently directed or aimed to a desired area. In certain exemplary embodiments, the LED worklight 800 includes a mechanical stop That extends outward from a back side of one of the panels 840, 870 that limits the rotation of the second panel 870 to approximately a 270 degree position.

Similar to the LED worklight 100, when the LED worklight 800 is positioned on a horizontal surface with the first panel 840 and the second panel 870 facing horizontally, the LED worklight 800 illuminates desired work areas including, but not limited to walls or other generally vertical work surfaces. The first panel 840 and the second panel 870, and the center core 810 provide stability to the LED worklight 800 by providing a substantially triangulated mount. Additionally, the LED worklight 800 is positionable horizontally, on a horizontal surface, such that the first panel 840 and the second panel 870 face vertically. In this position, the LED worklight 800 illuminates desired work areas including, but not limited to, ceilings or other generally horizontal work surfaces; for example the underside of a vehicle. The large, flat surfaces of the LED worklight 800 resist changing light output direction due to the inadvertent movement of the LED worklight 800 via a first friction ring and second friction ring (FIG. 3). Whether the LED worklight 800 is placed vertically on a horizontal surface or horizontally on a horizontal surface, the second panel 870 is positionable at any angle with respect to the first panel 840.

As described above, the LED worklight 800 includes the first attachment mechanism 830 and the second attachment mechanism 860 for hanging the LED worklight 800 from, or attaching the LED worklight 800 to or around, an object. In the illustrated embodiment, the first attachment mechanism 830 is located diagonally opposite the second attachment mechanism 860. In certain alternative exemplary embodiments, both the first and second attachment mechanisms 830, 860 are located at the top of the LED worklight 800 or both are located at the bottom of the LED worklight 800. In certain alternative exemplary embodiments, the LED worklight 800 includes only one attachment mechanism. In certain alternative exemplary embodiments, the LED worklight 800 includes more than two attachment mechanisms.

The attachment mechanisms 830, 860 provide versatility in mounting or hanging the LED worklight 800 so that the LED worklight 800 is oriented as desired. This versatility also allows the LED worklight 800 to be employed in many different applications that conventional lights are not suitable. The LED worklight 800 is especially advantageous in applications where there are few objects to hang a worklight from and applications where the nearby objects are large or bulky preventing a hook from coupling directly to the object.

One or both attachment mechanisms 830, 860 can be used to hang the LED worklight 800 to one or more suitable objects. In one example, the hooks 832, 862 of the attachment mechanisms 830, 860 are attached to the same elevated object or to separate objects that are adjacent to or spaced apart from one another. For example, in an automotive repair application, one of the hooks 832 or 862 is attached to an opening in one side of an automobile's hood while the other hook 832 or 862 is attached to an opening on the other side of the automobile's hood. Thus, the LED worklight 800 is suspended from the automobile's hood to direct light downward from the hood and substantially in the area of the automobile's engine. In addition, the LED worklight 800 is capable of being coupled to objects under the body of the automobile to direct light upwards into the automobile's undercarriage.

Figure 16:
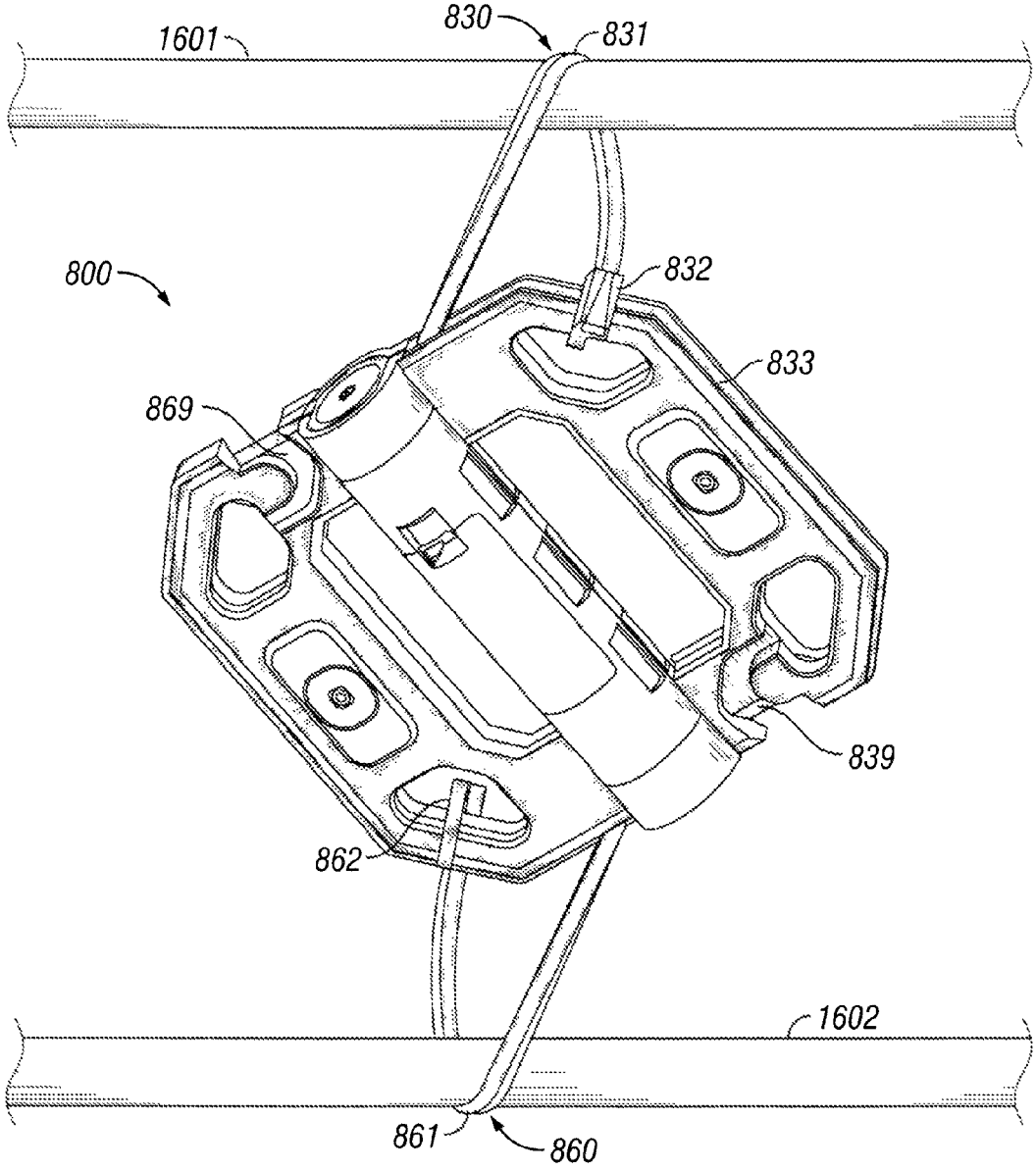
FIG. 16 shows the LED worklight of FIG. 8 coupled to objects, in accordance with an exemplary embodiment.

One or both attachment mechanisms 830, 860 are capable of being used to attach the LED worklight 800 to one or more objects by wrapping their respective elastic bands 831, 861 around the object(s) and attaching the hooks 832, 862 to the LED worklight 800, to an object, or interlocking the two hooks 832, 862 together. In one example, as illustrated in FIG. 16, the LED worklight 800 is coupled to two parallel pipes 1601 and 1602. Referring to FIG. 16, the first attachment mechanism 830 is coupled the first pipe 1601, while the second attachment mechanism 860 is coupled to the second pipe 1602. In particular, the elastic band 831 of the first attachment mechanism 830 wraps around the first pipe 1601 and the hook 832 is attached to the hole 835. Similarly, the elastic band 861 of the second attachment mechanism 860 wraps around the second pipe 1602 and the hook 862 is attached to the hole 865. In this configuration, the LED worklight 800 is securely attached between the two pipes 1601, 1602 and positioned such that the light output by the LED worklight 800 is directed at a desired work area. For example, if the pipes 1601, 1602 are located above a work area, the LED worklight 800 couples to the pipes 1601, 1602 to direct lighting onto the work area. In another example, if the pipes 1601, 1602 run vertically, the LED worklight 800 is capable of being coupled to the pipes 1601, 1602 to direct light in a substantially horizontal direction.

In another example, the LED worklight 800 is attached to a vertical pole or tree by wrapping both elastic bands 831, 861 around the pole or tree and interlocking the two hooks 832, 862. In yet another example, one of the attachment mechanisms 830 or 860 is wrapped around an object and the hook 832 or 862 is attached to any one of the holes of the LED worklight 800. In addition, the LED worklight 800 is capable of being mounted to a vertical surface or to a vertical angling surface using the magnets 1178-1198, similar to the LED worklight 100 described above. One or both attachment mechanisms 830, 860 also can be used in conjunction with one or more of the magnets 1178-1198 or with one or more suction cups (not shown).

The LED worklight 800 is stored in a manner to protect the first panel lens 852 and the second panel lens 882 from damage. Since one of the panels 840, 870 is rotatable with respect to the other, the LED worklight 800 is stored with, for example, the second panel 870 positioned in the 0 degree orientation, or closed configuration, in which the first panel lens 852 faces the second panel lens 882. This closed configuration for the LED worklight 800 is similar to the closed configuration of the LED worklight 100 as illustrated in FIG. 2. The ability to protect the panel lenses when not in use lengthens the useful life of the LED worklight 800 and provides more freedom for the user when selecting storage locations. Additionally, the LED worklight 800 reduces in width by about forty percent when the second panel 870 is in the closed orientation, i.e., 0 degree orientation. This reduction in width also provides more freedom to the user when selecting a storage location.

Moreover, the LED worklight 800 provides versatility when operating the first LED and second LED die packages 842, 872, which also extends the battery pack's life. The LED worklight 800 operates alternatively with both the first LED die package 842 and the second LED die package 872 fully on, the first LED die package 842 and the second LED die package 872 off, the first LED die package 842 on and the second LED die package 872 off, the first LED die package 842 off and the second LED die package 872 on, or either or both the first LED die package 842 and the second LED die package 872 being dimmable. This adjustability provides the appropriate amount of light output that is necessary, thereby prolonging the battery pack's life.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the invention. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A portable worklight, comprising:

a first panel coupled to a center core;

a first light source comprising one or more light emitting diodes (LEDs) disposed on the first panel;

a first attachment mechanism comprising a hook coupled to the first panel;

a second panel rotatably coupled to the center core; and a second light source comprising one or more LEDs disposed on the second panel, wherein the first panel further comprises a recessed area on a front surface of the first panel, the recessed area receiving at least a portion of the hook when not in use.

2. The portable worklight of claim 1, wherein the first attachment mechanism is rotatably coupled to the first panel.

3. The portable worklight of claim 1, further comprising at least one magnet coupled to a rear surface of at least one of the first and second panels.

4. The portable worklight of claim 1, wherein the interior of the center core comprises a cavity for receiving a replaceable power source.

5. The portable worklight of claim 1, further comprising a switch mechanism, the switch mechanism comprising a manually adjustable portion disposed on the exterior of the center core.

6. The portable worklight of claim 5, wherein the manually adjustable portion is disposed along a top portion of the center core.

7. The portable worklight of claim 5, wherein the manually adjustable portion is disposed along a portion of a middle section of the center core.

8. The portable worklight of claim 1, further comprising at least one aperture disposed through at least one of the first and second panels, the aperture configured to couple to the hook.

9. The portable worklight of claim 1, further comprising a second attachment mechanism comprising a second hook coupled to the second panel.

10. The portable worklight of claim 9, wherein the second panel further comprises a recessed area on a front surface of the second panel, the recessed area receiving at least a portion of the second hook of the second attachment mechanism when not in use.

11. A portable worklight, comprising:

a center core;

a substantially C-shaped first panel coupled to the center core;

a first light source coupled to the first panel;

a first attachment mechanism rotatably coupled to the first panel;

a substantially C-shaped second panel rotatably coupled to the center core; and a second light source coupled to the second panel.

12. The portable worklight of claim 11, wherein the first attachment mechanism comprises a hook.

13. The portable worklight of claim 11, further comprising at least one magnet coupled to a rear surface of at least one of the first and second panels.

14. A portable worklight, comprising:

a first panel coupled to a center core;

a first light source comprising one or more light emitting diodes (LEDs) disposed on the first panel;

a first attachment mechanism comprising a hook coupled to the first panel;

a second panel rotatably coupled to the center core;

a second light source comprising one or more LEDs disposed on the second panel; and at least one aperture disposed through at least one of the first and second panels, the aperture configured to couple to the hook.

15. The portable worklight of claim 14, wherein the first attachment mechanism is rotatably coupled to the first panel.

16. The portable worklight of claim 14, further comprising at least one magnet coupled to a rear surface of at least one of the first and second panels.

17. The portable worklight of claim 14, wherein the interior of the center core comprises a cavity for receiving a replaceable power source.

18. The portable worklight of claim 14, further comprising a switch mechanism, the switch mechanism comprising a manually adjustable portion disposed on the exterior of the center core.

19. The portable worklight of claim 18, wherein the manually adjustable portion is disposed along a top portion of the center core.

20. The portable worklight of claim 18, wherein the manually adjustable portion is disposed along a portion of a middle section of the center core.

* * * * *